US006860767B2

(12) United States Patent
Takahashi et al.

(10) Patent No.: US 6,860,767 B2
(45) Date of Patent: Mar. 1, 2005

(54) CONNECTOR HAVING AN IMPROVED FRONT HOLDER DESIGN FOR RETAINING TERMINALS

(75) Inventors: Toshiharu Takahashi, Haibara-gun (JP); Motoyoshi Suzuki, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/628,328

(22) Filed: Jul. 29, 2003

(65) Prior Publication Data

US 2004/0038589 A1 Feb. 26, 2004

(30) Foreign Application Priority Data

Jul. 29, 2002 (JP) ..... P2002-220304
Jul. 29, 2002 (JP) ..... P2002-220314

(51) Int. Cl.[7] ..... H01R 13/426
(52) U.S. Cl. ..... 439/752; 439/595
(58) Field of Search ..... 439/752, 595, 439/533, 656

(56) References Cited

U.S. PATENT DOCUMENTS 5,037,336 A 8/1991 Betsui ..... 439/752
5,061,210 A 10/1991 Jinno
5,397,249 A * 3/1995 Endo et al. ..... 439/595
5,439,397 A 8/1995 Yamanashi et al.
5,618,207 A 4/1997 Maejima ..... 439/595
5,928,038 A * 7/1999 Berg et al. ..... 439/752

FOREIGN PATENT DOCUMENTS

| | | |
|---|---|---|
| GB | 2 248 350 A | 4/1992 |
| JP | 7-57809 | 3/1995 |
| JP | 9-251874 | 9/1997 |
| JP | 11-86950 | 3/1999 |
| JP | 2000-182708 | 6/2000 |

* cited by examiner

*Primary Examiner*—Renee Luebke
(74) *Attorney, Agent, or Firm*—Sughrue Mion, PLLC

(57) ABSTRACT

A connector includes a housing, a front holder, a provisionally-retaining member and a completely-retaining member. The housing includes terminal receiving chambers in which metal terminals are accommodated and a plurality of elastic retaining arm portions for respectively retaining the metal terminals. The front holder is attached to the housing in a completely-retaining position through a provisionally-retaining position. The front holder prevents elastic deformation of the elastic retaining arm portions in the completely-retaining position but allows elastic deformation of the elastic retaining arm portions in the provisionally-retaining position. The completely-retaining member retains the front holder to the housing in the completely-retaining position and includes an operation portion for releasing the retaining of the housing and the holder, which is exposed to the exterior.

12 Claims, 19 Drawing Sheets

CONNECTOR HAVING AN IMPROVED FRONT HOLDER DESIGN FOR RETAINING TERMINALS

BACKGROUND OF THE INVENTION

This invention relates to a connector in which a front holder is attached to a housing, thereby preventing the withdrawal of metal terminals provided within the housing.

FIGS. 15 to 17 show a first related connector of this kind disclosed in JP-A-9-251874. As shown in FIGS. 15 to 17, this connector 50 includes a plurality of metal terminals (not shown) connected respectively to end portions of wires, a housing 52 for receiving the plurality of metal terminals therein, and a front holder 53 attached to the housing 52.

The housing 52 has many terminal receiving chambers 54 formed therein, and the metal terminals are received in these terminal receiving chambers 54, respectively. An elastic retaining arm portion (not shown) is provided in a projected manner in each terminal receiving chamber 54, and is supported at one end thereof on an upper face of the terminal receiving chamber 54. The metal terminal is retained by this elastic retaining arm portion. Slide grooves 55 are formed in opposite (right and left) side faces of the housing 52, respectively, and the pair of slide grooves 55 are exposed to the exterior. A housing-side first retaining portion 56 and a housing-side second retaining portion 57 are provided in each slide groove 55 in a projected manner.

The front holder 53 can be inserted into the housing 52 from a mating connector-fitting side of this housing, and a plurality of arm deformation prevention portions 60 are formed at an insertion end thereof. A pair of elastically deformable operating plates 59 are formed at opposite (right and left) sides of the front holder 53. A holder-side first retaining portion 61 and a holder-side second retaining portion 62 (which can be displaced by elastic deformation of the operating plate 59) are formed on each operating plate 59.

Next, an assembling operation of the connector 50 will be described. The front holder 53 is inserted into the housing 52 from the fitting side thereof. This front holder is inserted into a provisionally-retaining position where the pair of right and left holder-side first retaining portions 61 of the front holder 53 are retained respectively by the pair of right and left housing-side first retaining portions 56 of the housing 52 as shown in FIG. 16. In this provisionally-retained condition, the metal terminals (not shown) are inserted respectively into the terminal receiving chambers 54 of the housing 52 through rear open ends thereof, and the metal terminals are retained by the elastically-deformed elastic retaining arm portions (not shown), respectively.

Then, the operator moves the pair of operating plates 59 of the front holder 53 in an inserting direction A, thereby forcibly inserting the front holder 53. The front holder 53 is inserted into a completely-retaining position where the pair of right and left holder-side second retaining portions 62 of the front holder 53 are retained respectively by the pair of right and left housing-side second retaining portions 57 of the housing 52 as shown in FIG. 17. As a result, each arm deformation prevention portion 60 is inserted in a flexure space between the corresponding elastic retaining arm portion (not shown) and the upper face of the corresponding terminal receiving chamber 54, thereby limiting the elastic deformation of the elastic retaining arm portion (not shown). As a result, each metal terminal (not shown) is prevented form withdrawal.

When the front holder 53 is located in the provisionally-retaining position, the movement of the front holder 53 in the inserting direction A Is prevented by the retaining engagement of the pair of right and left second retaining portions 57 with the pair of right and left second retaining portions 62. Also, the movement of the front holder 53 in a withdrawing direction B is prevented by the retaining engagement of the pair of right and left first retaining portions 56 with the pair of right and left first retaining portions 61, as shown in FIG. 16. Therefore, the front holder 53 is provisionally attached to the housing 52, and the arm deformation prevention portions 60 of the front holder 53 are held in such a position as not to prevent the insertion of the metal terminals. When the front holder 53 is located in the completely-retaining position, the movement of the front holder 53 in the withdrawing direction B is prevented by the retaining engagement of the pair of right and left second retaining portions 57 with the pair of right and left second retaining portions 62 as shown in FIG. 17, and therefore the front holder 53 is completely attached to the housing 52, and the arm deformation prevention portions 60 of the front holder 53 are held respectively in predetermined positions to prevent the withdrawal of the metal terminals.

When the front holder 63 is moved from the completely-retaining position to the provisionally-retaining position because of some trouble (for example, because part of the plurality of metal terminals have failed to be properly inserted), the pair of operating plates 59 of the front holder 53 are pressed away from each other as indicated by arrows D (FIG. 15), thereby canceling the locking engagement of the pair of right and left holder-side second retaining projections 62 with the pair of housing-side second retaining projections 57, and then the front holder 53 is moved in the withdrawing direction B. The front holder 53 is drawn into the position where the pair of right and left holder-side first retaining projections 61 of the front holder 53 are retainingly engaged respectively with the pair of right and left first housing-side retaining projections 56 as shown in FIG. 16. At this time, the forcible displacement of the pair of right and left operating plates 59 of the front holder 53 is canceled, so that the front holder is held in this provisionally-retained position.

The above connector 50 has advantages that the insertion of the metal terminals can be effected while the front holder 53 is kept provisionally attached to the housing 52 and that when there is an error in the metal terminal-inserting operation, a metal terminal-reinserting operation can be effected.

In the related connector 50, however, when the front holder 53 is to be returned from the completely-retaining position to the provisionally-retaining position, the pair of right and left operating plates 59 must be operated at the same time, and therefore the operator can not easily effect this operation in a one-touch manner, which has invited a problem that the operability is bad. Particularly in the case of a flattened thin-type connector with a large width, the distance between the pair of right and left operating plates 59 is so large that the operator can not operate the pair of right and left operating plates 59 unless he uses both hands, and therefore the operability is not user friendliness.

Also, FIGS. 18 to 20 show a second related connector of this kind disclosed in JP-A-7-57809. As shown in FIGS. 18 to 20, this connector 150 includes a plurality of metal terminus 151 (shown in FIG. 20) connected respectively to end portions of wires, a housing 152 for receiving the plurality of metal terminals 151 therein, and a front holder 153 attached to the housing 152.

The housing 152 has many terminal receiving chambers 154 formed therein, and the metal terminals 151 are received in these terminal receiving chambers 154, respectively. An elastic retaining arm portion 155 is provided in a projected manner in each terminal receiving chamber 154, and is supported at one end thereof on an upper face of the terminal receiving chamber 154. The metal terminal 151 is retained by this elastic retaining arm portion 155. A housing-side first retaining portion 156 and a housing-side second retaining portion 157 are formed on and project from a front wall of the terminal receiving chamber 154.

The front holder 153 can be inserted into the housing 152 from a mating connector-fitting side of this housing, and a plurality of arm deformation prevention portions 160 are formed at an insertion end thereof. Holder-side first retaining portions 161 and holder-side second retaining portions 162 (which can be displaced by elastic deformation) are formed on the front holder 153 in a projected manner.

Next, an assembling operation of the connector 150 will be described. The front holder 153 is inserted into the housing 152 from the fitting side thereof. This front holder is inserted into a provisionally-retaining position where the holder-side first retaining portions 161 of the front holder 153 are retained respectively by the housing-side first retaining portions 156 of the housing 152 as shown in FIG. 19. In this provisionally-retained condition, the metal terminals 151 are inserted respectively into the terminal receiving chambers 154 of the housing 152 through rear open ends thereof, and the metal terminals 151 are retained by the elastically-deformed elastic retaining arm portions 155, respectively.

Then, the front holder 153, provisionally retained in the housing 152, is further inserted into the housing 152. More specifically, the front holder is inserted into a completely-retaining position where the holder-side second retaining portions 162 of the front holder 153 are retained respectively by the housing-side second retaining portions 157 of the housing 152 as shown in FIG. 20. As a result, each arm deformation prevention portion 160 is inserted in a flexure space between the corresponding elastic retaining arm portion 155 and the upper face of the corresponding terminal receiving chamber 154, thereby limiting the elastic deformation of the elastic retaining arm portion 155. As a result, each metal terminal 151 is prevented form withdrawal.

When the front holder 153 is located in the provisionally-retaining position, the movement of the front holder 153 in an inserting direction A is prevented by the retaining engagement between the second retaining portions 157 and 162, and the movement of the front holder 153 in a withdrawing direction B is prevented by the retaining engagement between the first retaining portions 156 and 161, as shown in FIG. 19. Therefore, the front holder 153 is provisionally attached to the housing 152, and the arm deformation prevention portions 160 of the front holder 153 are held in such a position as not to prevent the insertion of the metal terminals 151. When the front holder 153 is located in the completely-retaining position, the movement of the front holder 153 in the withdrawing direction B is prevented by the retaining engagement between the second retaining portions 157 and 162 as shown in FIG. 20, and therefore the front holder 153 is completely attached to the housing 152, and the arm deformation prevention portions 160 of the front holder 153 are held respectively in predetermined positions to prevent the withdrawal of the metal terminals 151.

The above connector 150 has an advantage that the insertion of the metal terminals 151 can be effected while the front holder 153 is kept provisionally attached to the housing 152

In the second related connector 150, however, the housing-side first retaining portions 156 and housing-side second retaining portions 157 of the housing 152 project from the front walls of the terminal receiving chambers 154, and when viewed from the direction of insertion of the front holder 153 into the housing 152, these first and second retaining portions 156 and 157 are disposed within a terminal receiving area where the plurality of terminal receiving chambers 154 are provided. Therefore, there are limitations such as a requirement that the housing-side first and second retaining portions 156 and 157 and the holder-side first and second retaining portions 161 and 162 should be so provided as not to affect the insertion of terminals of the mating connector. Therefore, these retaining portions can not be provided in a small-size connector in which small metal terminals are used, and the distance between adjacent terminal receiving chambers is small, and each terminal receiving chamber is formed by a small space. Even if such retaining portions can be provided, the desired position-holding force can not be obtained. Thus, these problems have been encountered.

SUMMARY OF THE INVENTION

It is therefore an object of the present invention to provide a connector, in which the locking of a front holder in a completely-retaining position can be canceled with a one-touch operation, and the efficiency of an operation for returning the front holder from the completely-retaining position to a provisionally-retaining position is high.

Also, the another object of the present invention is to provide a connector, in which even when small metal terminals are used, a front holder can be attached to a housing, and besides the front holder can be retained in a provisionally-retaining position and a completely-retaining position with a desired position-holding force.

In order to achieve the above object, according to the present invention, there is provided a connector, comprising:

a housing, including:

a plurality of terminal receiving chambers in which metal terminals are accommodated; and a plurality of elastic retaining arm portions for respectively retaining the metal terminals;

a front holder, attached to the housing in a completely-retaining position through a provisionally-retaining position;

wherein the front holder prevents the elastic deformation of the elastic retaining arm portions in the completely-retaining position; and wherein the front holder allows the elastic deformation of the elastic retaining arm portions in the provisionally-retaining position;

a provisionally-retaining member, retaining the front holder to the housing in the provisionally-retaining position; and a completely-retaining member, retaining the front holder to the housing in the completely-retaining position;

wherein the completely-retaining member is provided at one region so as to retain the housing and the front holder, and includes an operation portion for releasing the retaining of the housing and the holder, and the operating portion is disposed so as to be exposed to the exterior.

In the above configuration, the locking of the front holder in the completely-retaining position can be released by operating the single operating portion exposed to the exterior.

Preferably, the completely-retaining member includes a center retaining member which is provided generally at central portions of the housing and front holder.

Here, it is preferable that, the center retaining member includes a first retaining portion provided at one of the housing and the front holder, and a resilient arm lock portion provided at the other of the housing and the front holder;

wherein the resilient arm lock portion, includes;

an elastically-deformable arm which is fixed to the other of the housing and the front holder at one end of the arm;

a second retaining portion which is formed on and projecting from a free end portion of the arm; and the operating portion which is provided on the free end of the arm, and makes the arm elastically deformed so as to displace the second retaining portion into a lock released position; and wherein the second retaining portion of the resilient arm lock portion is engaged with the first retaining portion in the completely-retaining position.

In the above configurations, the locking force of the center retaining member is exerted at the central portions of the housing and front holder, so that the locking of the front holder in the completely-retaining position is stable.

Here, it is preferable that, the second retaining portion of the resilient arm lock portion is engaged with the first retaining portion in the provisionally-retaining position to prevent the front holder from moving from the provisionally-retaining position to the completely-retaining position.

Here, it is preferable that, the first retaining portion is provided on the housing. The resilient arm lock portion is provided on the front holder.

In the above configurations, the center retaining member serves also as part of the provisionally-retaining member, and the locking of the front holder in the provisionally-retaining position can be canceled by operating the single operating portion of the center retaining member.

Here, it is preferable that, an insertion hole is formed in the housing. The insertion hole is used for removing a mold when injection molding the first retaining portion of the housing. The resilient arm lock portion is inserted in the insertion hole when the front holder is disposed in the completely-retaining position.

In the above configuration, a dead space, used for removing the mold, is efficiently used.

Here, it is preferable that, the second retaining portion of the arm includes; a first face which is disposed close to the free end of the arm, and is slanted relative to a direction of extending of the arm; and a second face which is disposed close to the fixed end of the arm, and is perpendicular to the direction of extending of the arm. The first retaining portion includes; a third face which is slanted, and abuts against the first face of the second retaining portion in the provisionally-retaining position; and a fourth face which is generally parallel to the second face of the retaining portion, and abuts against the second face in the completely-retaining position.

Here, it is preferable that, the first retaining portion includes a pair of opposed first projections formed respectively on a pair of ribs extending parallel to the direction of extending of the resilient arm lock portion. The second retaining portion includes a pair of second projections formed on the arm.

Here, it is preferable that, the completely-fitted condition of the front holder and the housing is released by displacing the operating portion outwardly.

According to the present invention, there is also provided a connector, comprising:

a housing, including:

a plurality of terminal receiving chambers in which metal terminals are accommodated; and a plurality of elastic retaining arm portions for respectively retaining the metal terminals;

a front holder, inserted into the housing from a fitting side of the housing, and attached to the housing in a completely-retaining position through a provisionally-retaining position;

wherein the front holder prevents the elastic deformation of the elastic retaining arm portions in the completely-retaining position; and wherein the front holder allows the elastic deformation of the elastic retaining arm portions in the provisionally-retaining position;

a provisionally-retaining member, retaining the front holder in the housing in the provisionally-retaining position; and a completely-retaining member, retaining the front holder in the housing in the completely-retaining position;

wherein the provisionally-retaining member and the completely-retaining member are provided at outside of a terminal receiving area where the plurality of terminal receiving chambers are provided as viewed from a first direction in which the front holder is inserted into the housing;

wherein the provisionally-retaining member includes;

a pair of side retaining members which are respectively provided at both outsides of the terminal receiving area in a second direction perpendicular to the first direction; and a center retaining member which is provided at one outside of the terminal receiving area in a third direction perpendicular to both the first direction and the second direction; and wherein the completely-retaining member is formed by the center retaining member disposed generally at a central position of the terminal receiving area in the second direction.

In the above configuration, the provisionally-retaining member and the completely-retaining member are disposed outside the terminal receiving space, and therefore the structures of the provisionally-retaining member and completely-retaining member can be determined without imposing any limitation on the size of the metal terminals to be used. Also, the center retaining member serves as part of the provisionally-retaining member and also as the completely-retaining member.

Preferably, each of the side retaining members includes; a guide hole which is formed in one of the housing and the front holder, and extends in the first direction; and a retaining projection which is provided at the other of the housing and the front holder, and is slidably inserted in the guide hole. The retaining projection abuts against an end face of the guide hole to retain the front holder in the provisionally-retaining position.

Here, it is preferable that, the guide hole is formed in the front holder. The retaining projection is formed on the housing.

In the above configurations, the movement of the front holder between the provisionally-retaining position and the completely-retaining position is effected positively and smoothly.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
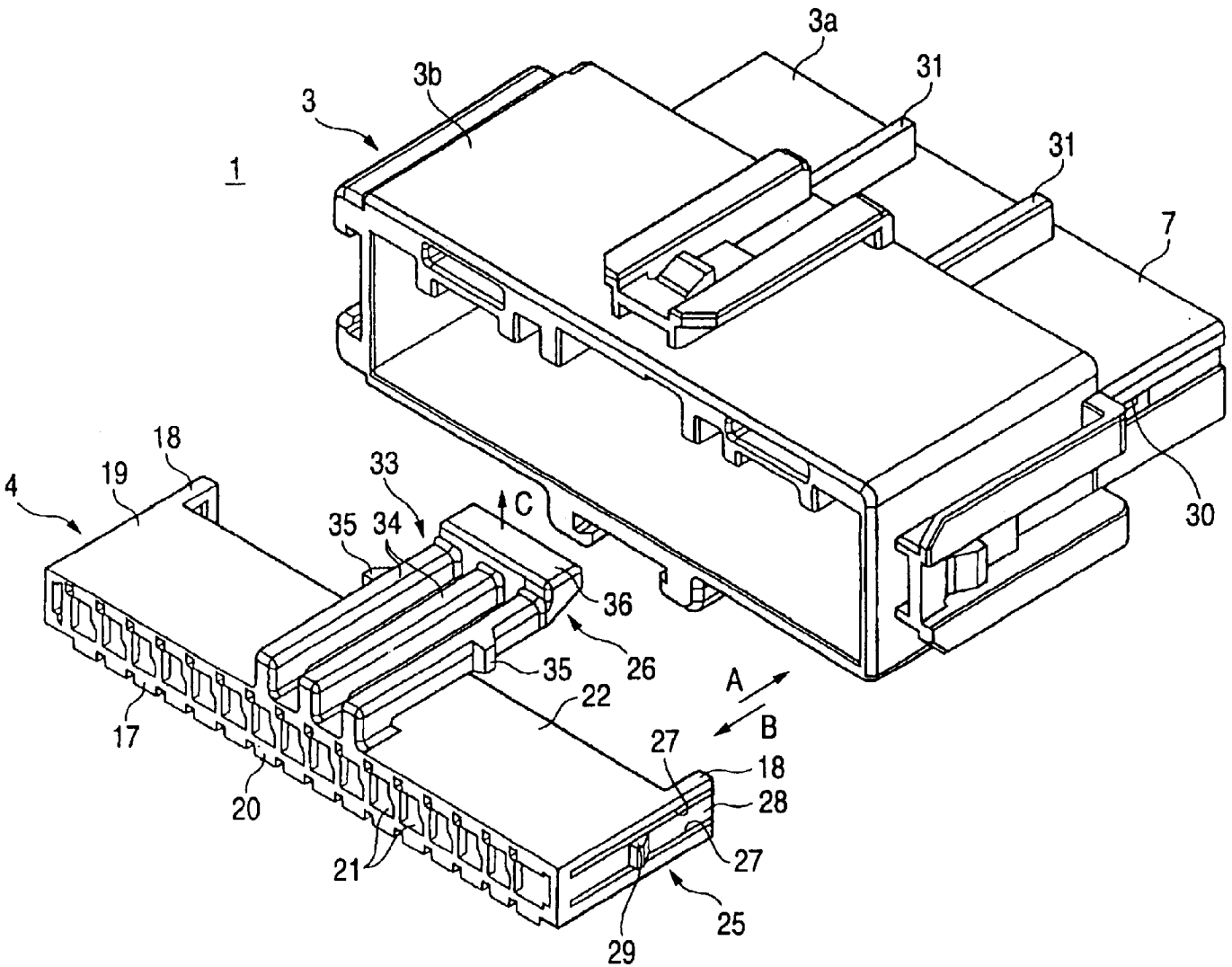
FIG. 1 is an exploded, perspective view of one preferred embodiment of the invention, showing a housing and a front holder.
Figure 2:
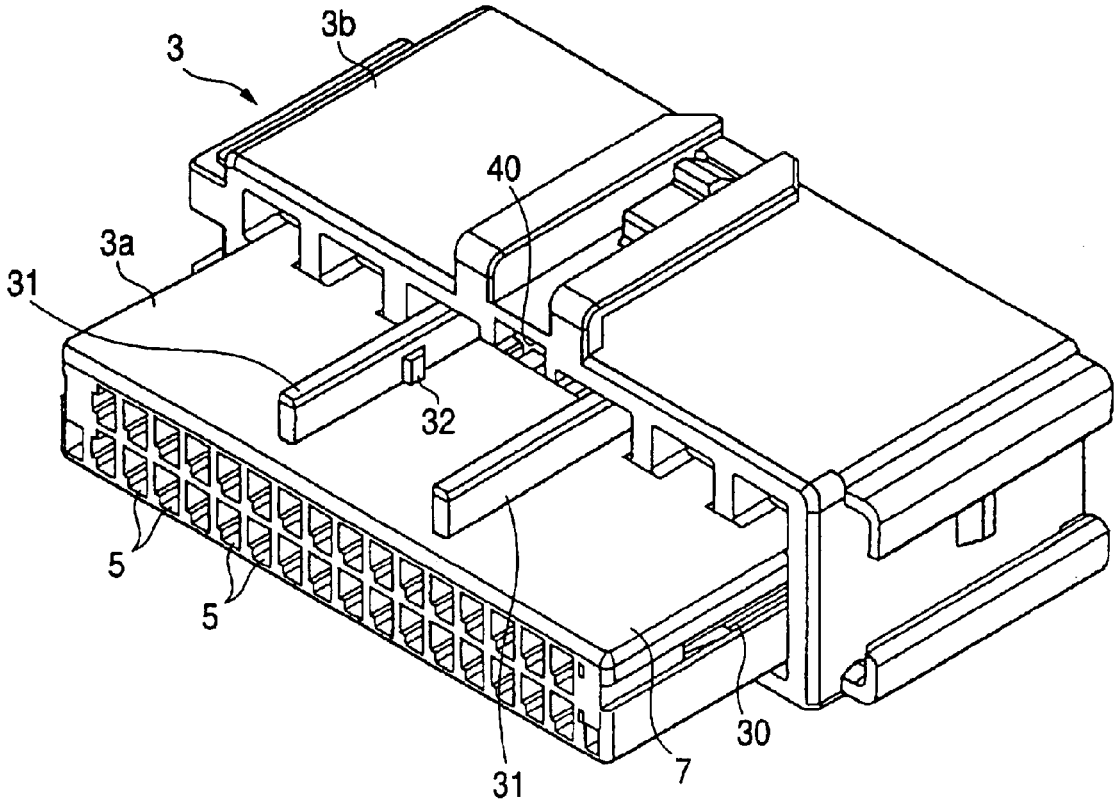
FIG. 2 is a perspective view of the housing of the invention as seen from a direction opposite to the direction from which this housing is seen in FIG. 1.
Figure 3:
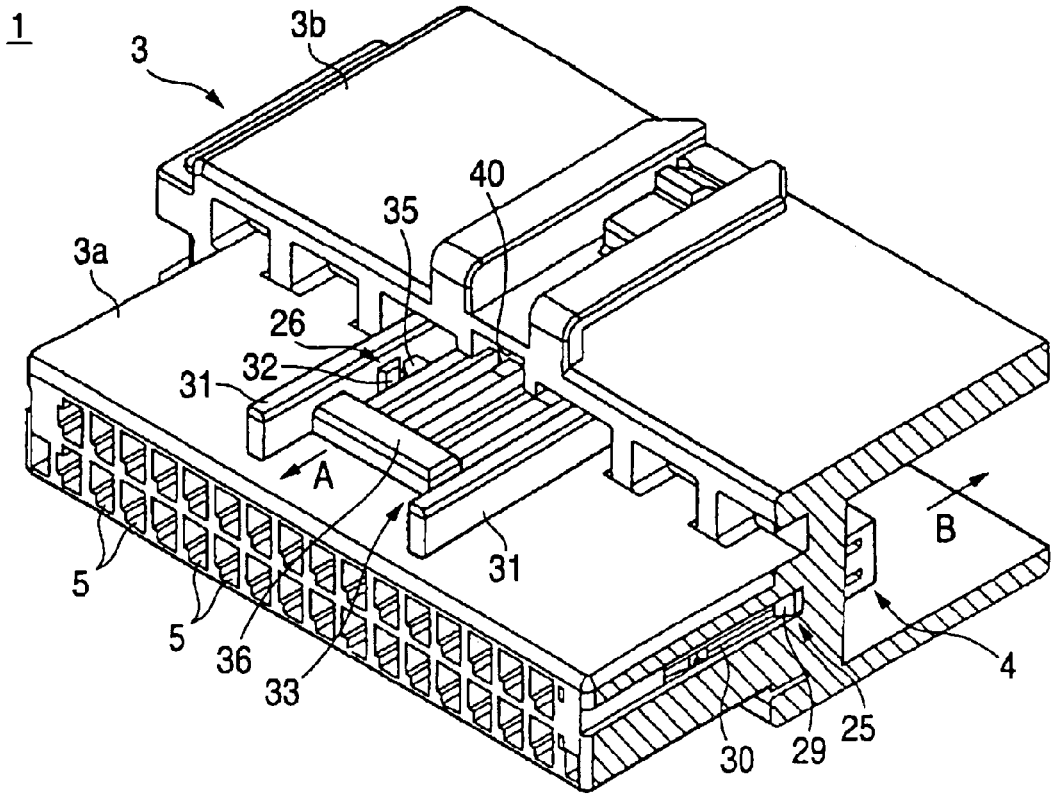
FIG. 3 is a partly-broken perspective view, of a connector of the invention, showing side retaining member, with the front holder located in a provisionally-retaining position.
Figure 4:
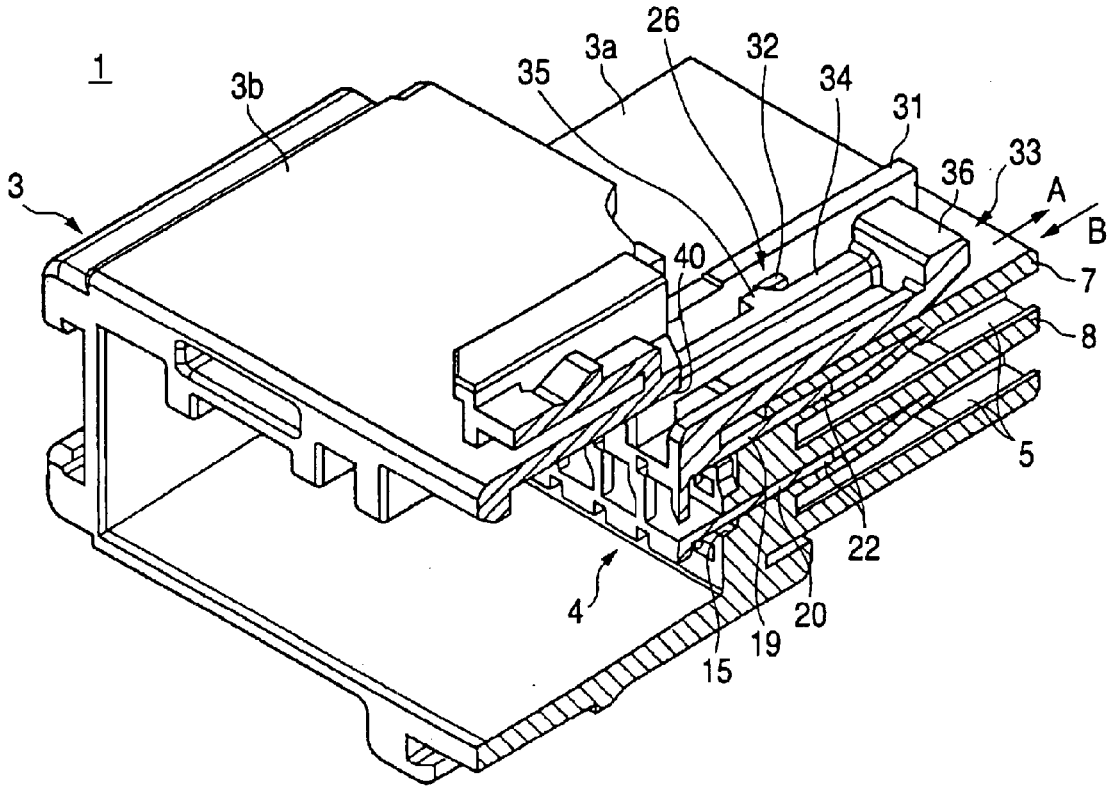
FIG. 4 is a partly-broken perspective view of the connector of the invention, showing center retaining member, with the front holder located in the provisionally-retaining position.
Figure 5:
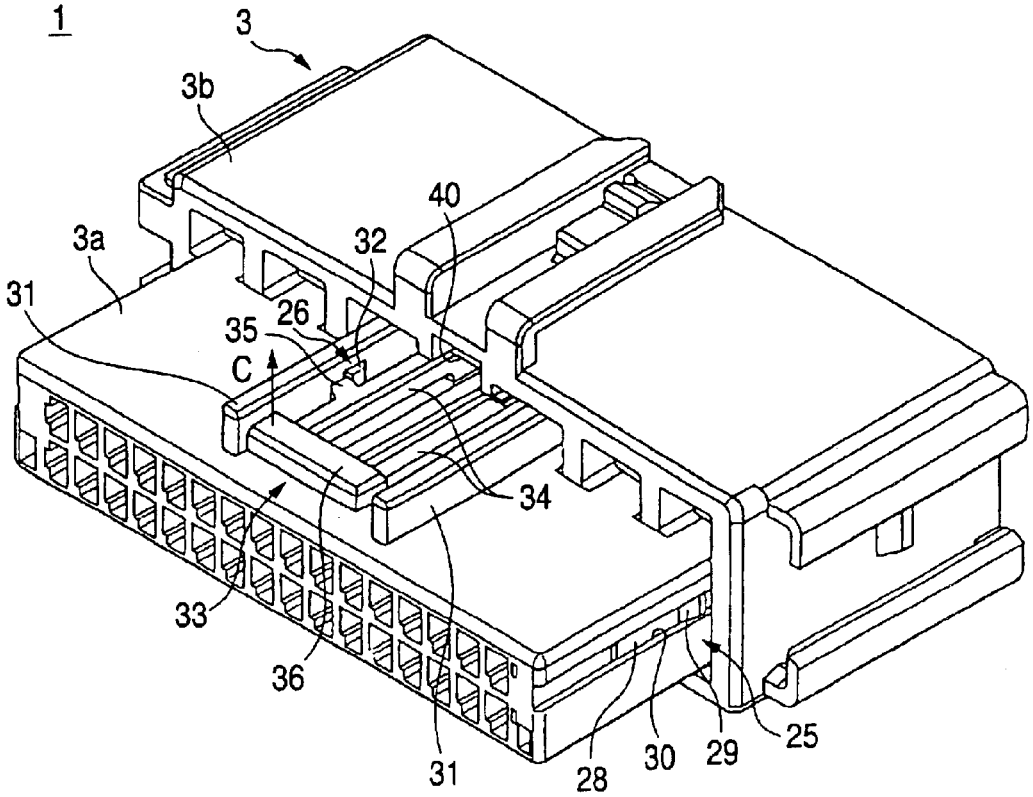
FIG. 5 is a perspective view of the connector of the invention, showing a condition in which the front holder is located in a completely-retaining position.
Figure 6:
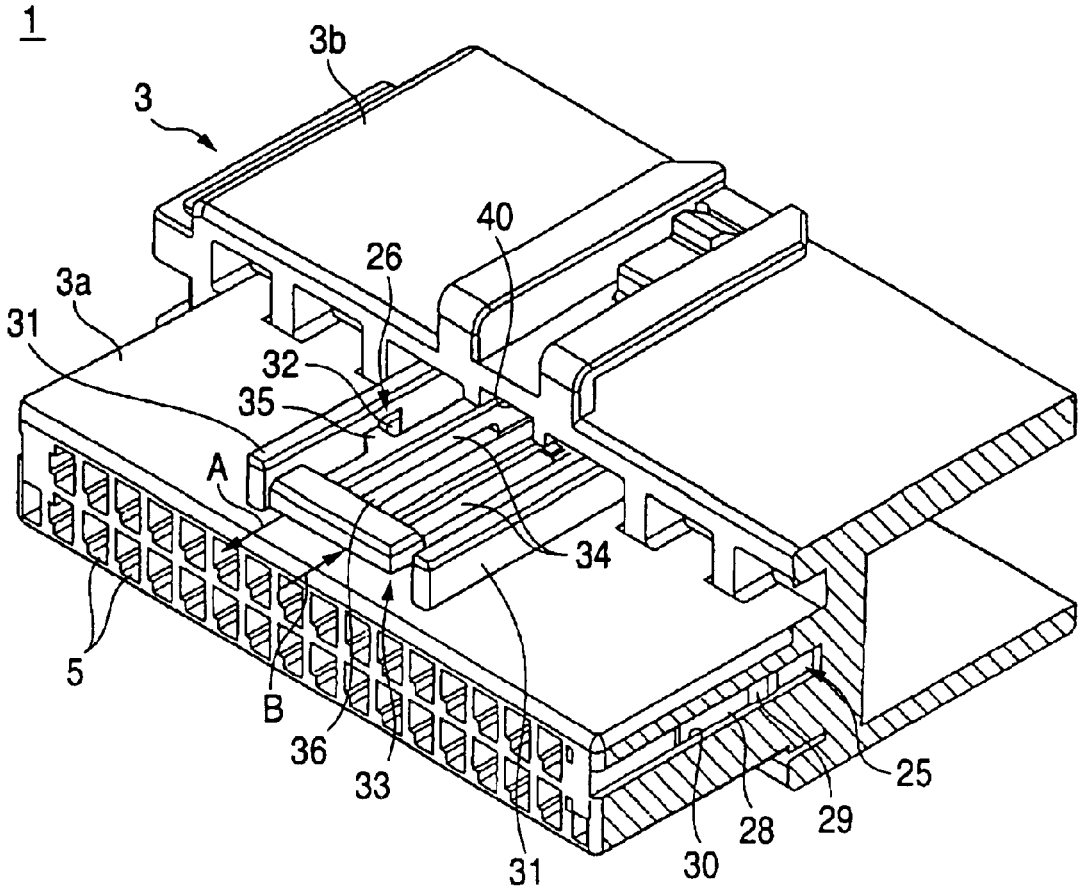
FIG. 6 is a partly-broken perspective view of the connector of the invention, showing the side retaining member, with the front holder located in the completely-retaining position.
Figure 7:
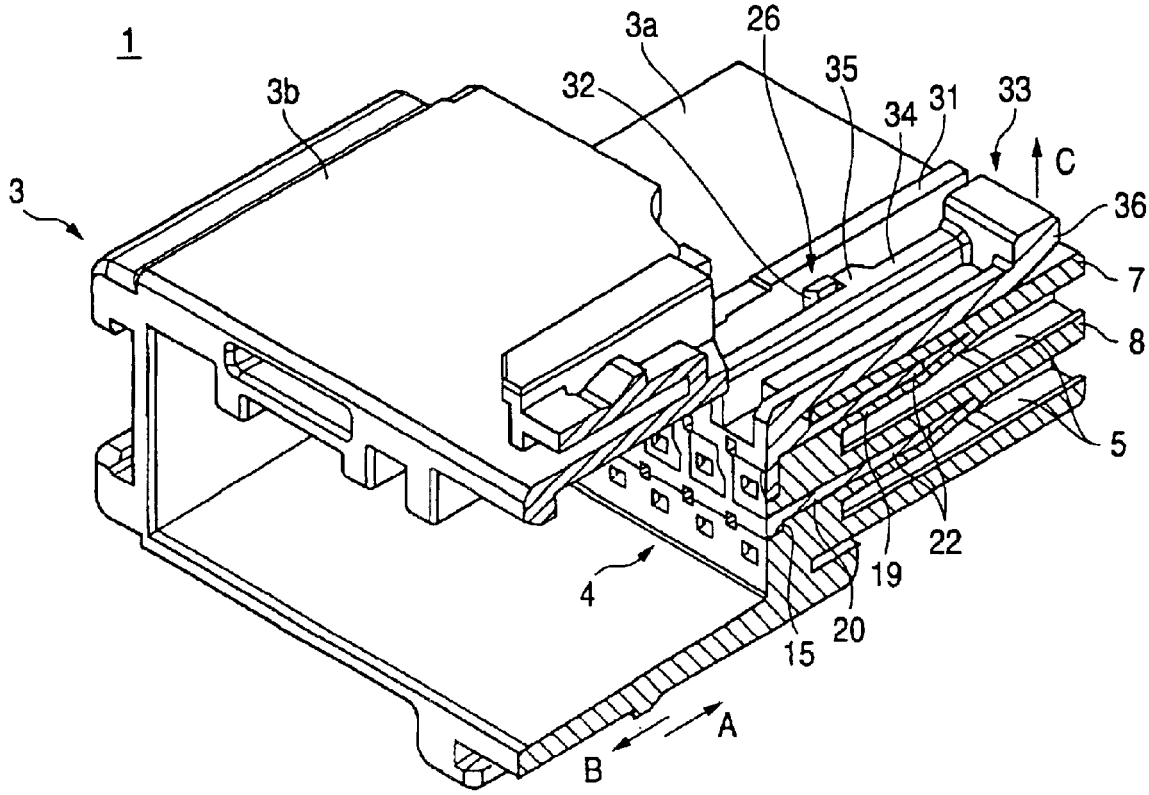
FIG. 7 is a partly-broken perspective view of the connector of the invention, showing the center retaining member, with the front holder located in the completely-retaining position.

A first embodiment of the present invention will now be described with reference to the drawings, FIGS. 1 to 7 show the first embodiment of the invention, and FIG. 1 is an exploded, perspective view showing a housing 3 and a front holder 4, FIG. 2 is a perspective view of the housing 3 as seen from a direction opposite to the direction from which this housing is seen in FIG. 1, FIG. 3 is a partly-broken perspective view of a connector 1, showing side retaining member 25, with the front holder 4 located in a provisionally-retaining position, and FIG. 4 is a partly-broken perspective view of the connector 1, showing center retaining member 26, with the front holder 4 located in the provisionally-retaining position, FIG. 5 is a perspective view of the connector 1, showing a condition in which the front holder 4 is located in a completely-retaining position, FIG. 6 is a partly-broken perspective view of the connector 1, showing the side retaining member 25, with the front holder 4 located in the completely-retaining position, and FIG. 7 is a partly-broken perspective view of the connector 1, showing the center retaining member 26, with the front holder 4 located in the completely-retaining position.

As shown in FIGS. 1 to 4, the connector 1 includes a plurality of male metal terminals (not shown) connected respectively to end portions of wires, the housing 3 for receiving the plurality of metal terminals therein, and the front holder 4 attached to the housing 3.

The housing 3 includes a housing body 3*a* of a generally flattened rectangular shape, and a hood portion 3*b* projected to a side of retaining face of the mating connector. A number of terminal receiving chambers 5 are formed in this housing body 3*a*, and the metal terminals are received in the terminal receiving chambers 5, respectively. The plurality of terminal receiving chambers 5 are arranged in two (upper and lower) rows (stages), and are juxtaposed in a transverse direction, and each terminal receiving chamber 5 has front and rear ends open to the exterior. Elastic retaining arm portions (not shown) extend from an inner face of an outer peripheral wall 7 respectively into the upper row of terminal receiving chambers 5, and elastic retaining arm portions (not shown) extend from a lower face of a partition wall 8 respectively into the lower row of terminal receiving chambers 5. The metal terminals are retained by theses elastic retaining arm portions, respectively A front plate-receiving recess 15 (shown in FIGS. 4 and 7) is formed in the fitting side (face) of the housing 3 (into which a mating connector (not shown) is fitted) such that the upper-stage terminal insertion port side of this housing is recessed by a predetermined amount. A pair of right and left side plate-inserting holes (not shown) are formed in the housing 3, and are disposed respectively exteriorly of right and left sides of a terminal receiving area where the plurality of terminal receiving chambers 5 are provided. The front holder 4 can be inserted into the housing, using the front plate-receiving recess 15, the side plate-inserting holes and so on.

A lock portion (not shown) for locking the mating connector (not shown) is formed at an inner face of an upper wall of the hood portion 3*b*.

The front holder 4 includes a front plate portion 17, right and left side plate portions 18 extending rearwardly respectively from opposite ends of the front plate portion 17, and a pair of upper and lower plate portions 19 and 20 extending rearwardly respectively from upper and lower edges of the front plate portion 17. The front holder 4 is inserted into the housing 3 such that rear end portions of the side plate portions 18 serve as inserting distal ends. Upper-stage terminal insertion ports 21 are formed in the front plate portion 17. Rear end portions of the upper and lower plate portions 19 and 20 serve as arm deformation prevention portions 22, respectively, and each arm deformation prevention portion 22 is inserted in flexure spaces each formed between the elastic retaining arm portion (not shown) and the upper face of the terminal receiving chamber 5.

Provisionally-retaining member (or mechanism) for holding the front holder 4 in the provisionally-retaining position during the insertion of the front holder 4 into the housing 3) and completely-retaining member (or mechanism) for holding the front holder 4 in the completely-retaining position are provided between the housing 3 and the front holder 4.

In the first embodiment, the provisionally-retaining member includes the pair of right and left side retaining member 25 which are provided respectively exteriorly of the right and left sides of the terminal receiving area (when viewed from a direction A of insertion of the front holder 4 into the housing 3) where the plurality of terminal receiving chambers 5 are provided, and the center retaining member (or mechanism) 26 provided above the terminal receiving area. In this embodiment, the completely-retaining member includes this center retaining member 26. Namely, the center retaining member 26 serves as part of the provisionally-retaining member and also as the completely-retaining member.

Each of the side retaining member 25 includes a retaining projection 29 formed on an arm portion 28 (which is formed at the side plate portion 18 of the front holder 4, and is made elastically deformable by notches 27), and a guide hole 30 which is formed in a side wall of the housing 3, and extends in the direction A of insertion of the front holder 4. In the provisionally-retaining position, the retaining projection 29 abuts against an end face of the guide hole 30.

The center retaining member 26 includes a pair of retaining projections 32 which are disposed at a widthwise-central portion of the outer peripheral wall 7 of the housing body 3*a*, and are formed respectively on inner faces of a pair of right and left ribs 31, and a resilient arm lock portion 33 which is formed on and projects upwardly from a widthwise central portion of the upper plate portion 19 of the front holder 4.

As shown in FIG. 3, a rear face of each of the two retaining projections 32 in the direction A of insertion of the front holder 4 is defined by a slanting face, and a front face thereof is defined by a vertical face. An arm lock-inserting hole 40 is formed in a rear end of the hood portion 3*b* connected to the housing body 3*a*, utilizing a space used for removing a mold when injection molding the pair of retaining projections 32. When the front holder 4 is located in the provisionally-retaining position and the completely-retaining position, the resilient arm lock portion 33 extends through the arm lock-inserting hole 40.

The resilient arm lock portion 33 includes three arm portions 34, a pair of retaining projection 35 and an operating portion 36. The three arm portions 34 are fixedly secured at their one end to the upper plate portion 19, and have the other end portions (free end portions) extending toward the inserting distal end of the front holder 4. The retaining projection 35 is formed respectively on generally-central portions of outer side faces of the (two) opposite side arm portions 34 among the three arm portions 34 The operating portion 36 interconnects the free ends of the three arm portions 34. The three arm portions 34 can be elastically deformed in upward and downward directions and also in right and left directions. A rear face of each of the two retaining projections 35 in the direction A of insertion of the front holder 4 is defined by a vertical face, and a front face thereof is defined by a slanting face. When the front holder 4 is located in the provisionally-retaining position and the completely-retaining position, the operating portion 36 is disposed between the pair of ribs 31, and is exposed to the exterior so that the operator can operate this operating portion 36 with his finger. When the operating portion 36 is displaced in the upward direction C, the arm portions 34 are elastically deformed, so that the pair of retaining projections 35 are displaced upwardly so as not to interfere with the retaining projections 32. The positional relation is so determined that in the provisionally-retaining position, the retaining projections 35 of the resilient arm lock portions 33 can abut respectively against the rear faces of the retaining projections 32 and that in the completely-retaining position, the retaining projections 35 of the resilient arm lock portions 33 can abut respectively against the front faces of the retaining projections 32.

Next, the assembling operation of the connector 1 will be described. The front holder 4 is inserted into the hood portion 3*b* through an opening thereof, and the thus inserted front holder 4 is inserted into the housing body 3*a* from the fitting side thereof. In this inserting operation, the pair of arm portions 28 of the front holder 4 are forcibly elastically deformed toward each other, so that the pair of retaining projections 29 are engaged respectively in the pair of guide holes 30 in the housing 3, and therefore the front holder is located in the provisionally-retaining position as shown in FIGS. 3 and 4. As a result of insertion of the front holder 4, the resilient arm lock portion 33 enters the arm lock-inserting hole 40 in the housing 3, so that the pair of retaining projections 35 of the resilient arm lock portion 33 abut respectively against the pair of retaining projections 32 of the housing 3. In this provisionally-retaining position, the movement of the front holder 4 in the inserting direction A is prevented by the retaining engagement between the retaining projections 32 and the retaining projections 35 of the center retaining member 26, and also the movement of the front holder 4 in the withdrawing direction B is prevented by the retaining engagement between the retaining projection 29 of each of the two side retaining member 26 and the end face of the corresponding guide hole 30. Therefore, the front holder 4 is provisionally attached to the housing 3, and also the arm deformation prevention portions 22 of the front holder 4 are held respectively in predetermined positions so as not to prevent the insertion of the metal terminals (not shown).

In this provisionally-retained condition, the metal terminals (not shown) are inserted respectively into the terminal receiving chambers 5 of the housing 3 through the rear open ends thereof. As a result, the distal end of each metal terminal is brought into abutting engagement with the corresponding elastic retaining arm portion (not shown). In this condition, when the metal terminal is further inserted, the free end portion of the elastic retaining arm portion is elastically deformed into the flexure space, thereby allowing the insertion of the metal terminal. When the metal terminal is inserted into the proper inserting position, the free end portion of the elastic retaining arm portion is brought into registry with a retaining portion (not shown) of the metal terminal, and therefore is elastically restored to retain the metal terminal.

Then, the operating portion 36 of the resilient arm lock portion 33, formed on the front holder 4 held in the provisionally-retained condition at the fitting side (front side) of the housing 3, is pulled in the inserting direction A As a result, the opposite side arm portions 34 are elastically deformed toward each other so as to slide respectively over the pair of retaining projections 32, thereby allowing the insertion of the front holder 4 into the housing 3. Then, the front holder 4 is inserted into the completely-retaining position where the pair of retaining projection 35 of the resilient arm lock portion 33 of the front holder 4 are retainingly engaged respectively with the pair of retaining projections 32 of the housing 3 as shown in FIGS. 5 to 7. As a result of insertion of the front holder 4, each arm deformation prevention portion 22 is inserted in the flexure spaces each formed between the elastic retaining arm portion and the upper face of the terminal receiving chamber 5. In the completely-retaining position, the movement of the front holder 4 in the withdrawing direction B is prevented by the retaining engagement between the retaining projections 32 and retaining projections 35 of the center retaining member 26, and therefore the front holder 4 is completely attached to the housing 3, and also the arm deformation prevention portions 22 are held respectively in predetermined positions to prevent the withdrawal of the metal terminals (not shown).

When the front holder 4 is moved from the completely-retaining position to the provisionally-retaining position because of some trouble (for example, because part of the plurality of metal terminals have failed to be properly inserted), the operating portion 36 of the resilient arm lock portion 33 is displaced in an upward direction C to elastically deform the arm portions 34, thereby bringing the pair of retaining projections 35 into a locking cancellation position where these retaining projections 35 are disposed out of locking engagement with the pair of retaining projections 32, respectively, and then the front holder 4 is drawn from the housing 3. At this time, the front holder 4 is drawn into the position where each of the two retaining projections 29 of the front holder 4 is retainingly engaged with be end face of the corresponding guide hole 30 in housing 3 as shown in FIGS. 3 and 4, and then the upward displacement of the operating portion 36 of the resilient arm lock portion 33 is canceled, thus holding the front holder in the provisionally-retaining position.

As described above, in the connector 1, the operator can cancel the locking of the front holder in the completely-retaining position by operating the single operating portion 36 exposed to the exterior, and therefore the locking of the front holder 4 in the completely-retaining position can be canceled with the one-touch operation, and the efficiency of the operation for returning the front holder 4 from the completely-retaining position to the provisionally-retaining position is high.

In the first embodiment, the completely-retaining member includes the center retaining member 26 provided generally at the central portions of the housing 3 and front holder 4, and therefore the locking force of the center retaining member 26 is exerted at the central portions of the housing 3 and front holder 4, so that the locking of the front holder in the completely-retaining position is stable.

In the first embodiment, the center retaining member 26 includes the retaining projections 32 provided at the housing 3, and the resilient arm lock portion 33 provided at the front holder 4. This resilient arm lock portion 33 includes the elastically-deformable arm portions 34 fixedly secured at their one end to the front holder 4, the retaining projections 35 formed on the free end portions of the arm portions 34, and the operating portion 36 which is fixedly secured to the free ends of the arm portions 34, and can elastically deform the arm portions 34 to displace the retaining projections 35 into the locking cancellation position. In the completely-retaining position, the retaining projections 35 of the resilient arm lock portion 33 are retainingly engaged respectively with the retaining projections 32. However, the center retaining member 26 is not limited to this construction, but need only to be so constructed as to hold the front holder 4 in the completely-retaining position.

In the first embodiment, also in the provisionally-retaining position, the retaining projections 35 of the resilient arm lock portion 33 interfere respectively with the retaining projections 32 to prevent the front holder from moving from the provisionally-retaining position to the completely-retaining position. Therefore, the center retaining member 26 serves also as part of the provisionally-retaining member, and the locking of the front holder in the provisionally-retaining position can be canceled by operating the single operating portion 36 of the center retaining member 26. Therefore, the locking of the front holder 4 in the provisionally-retaining position can be canceled with the one-touch operation, and the efficiency of the operation for moving the front holder 4 from the provisionally-retaining position to the completely-retaining position is high.

In the first embodiment, although the retaining projections 32 are formed at the housing 3, while the resilient arm lock portion 33 is formed at the front holder 4, there may be adopted a reverse construction in which the retaining projections 32 are formed at the front holder 4 while the resilient arm lock portion 33 is formed at the housing 3.

In the first embodiment, the arm lock-inserting hole 40 is formed, utilizing the space used for removing the mold when injection molding the retaining projections 32 of the housing 3. When the front holder 4 is located in the completely-retaining position, the resilient arm lock portion 33 extends through the arm lock-inserting hole 40, and therefore a dead space, used for removing the mold, is efficiently used, and this contributes to the space-saving design and compact design of the connector 1.

In the first embodiment, the provisionally-retaining member includes the pair of right and left side retaining member 25 which are provided respectively exteriorly of the right and left sides of the terminal receiving area, and the center retaining member 26 provided exteriorly of one of the upper and lower sides of the terminal receiving area. The completely-retaining member includes this center retaining member 26. Thus, the center retaining member 26 serves as part of the provisionally-retaining member and also as the completely-retaining member, and therefore the pair of side retaining member 25 can be simplified in construction.

In the first embodiment, each of the side retaining member 25 includes the guide hole 30 which is formed in the housing 3, and extends in the direction A of insertion of the font holder 4, and the retaining projection 29 which is provided at the front holder 4, and is slidably inserted in the guide hole 30. In the provisionally-retaining position, the retaining projection 29 abuts against the end face of the guide hole 30, thereby holding the front holder in position, and therefore the movement of the front holder 4 between the provisionally-retaining position and the completely-retaining position is effected positively and smoothly. In the above embodiment, although the guide holes 30 are formed in the housing 3, while the retaining projections 29 are formed on the front holder 4, there may be adopted a reverse construction in which the retaining projections 29 are formed on the housing 3 while the guide holes 30 are formed in the front holder 4.

In the first embodiment, although the present invention is applied to the connector 1 for the male terminals, the invention can, of course, be applied to a connector for female terminals.

Next, a second embodiment of the present invention will now be described with reference to the drawings.

Figure 8:
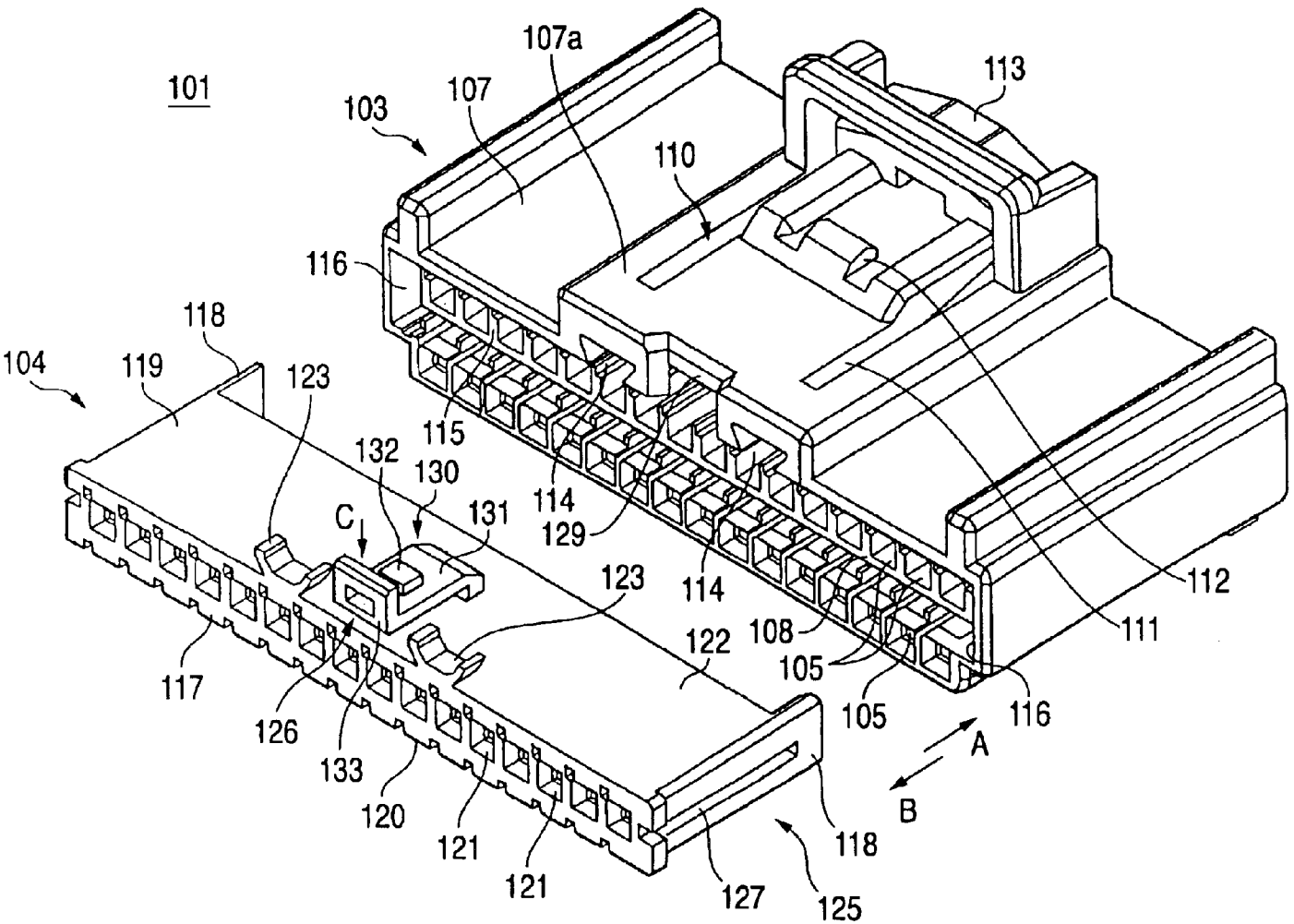
FIG. 8 is an exploded, perspective view of one preferred embodiment of the invention, showing a housing and a front holder.
Figure 9:
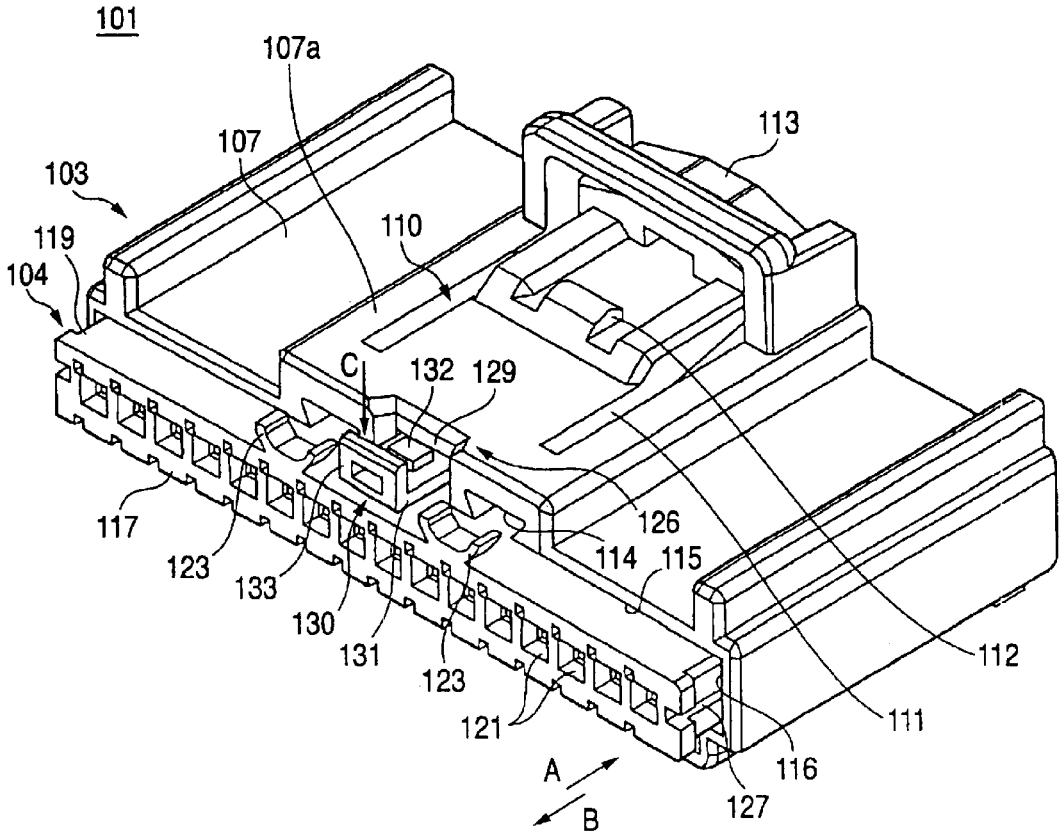
FIG. 9 is a perspective view of a connector of the invention, showing a condition in which the front holder is located in a provisionally-retaining position.
Figure 10:
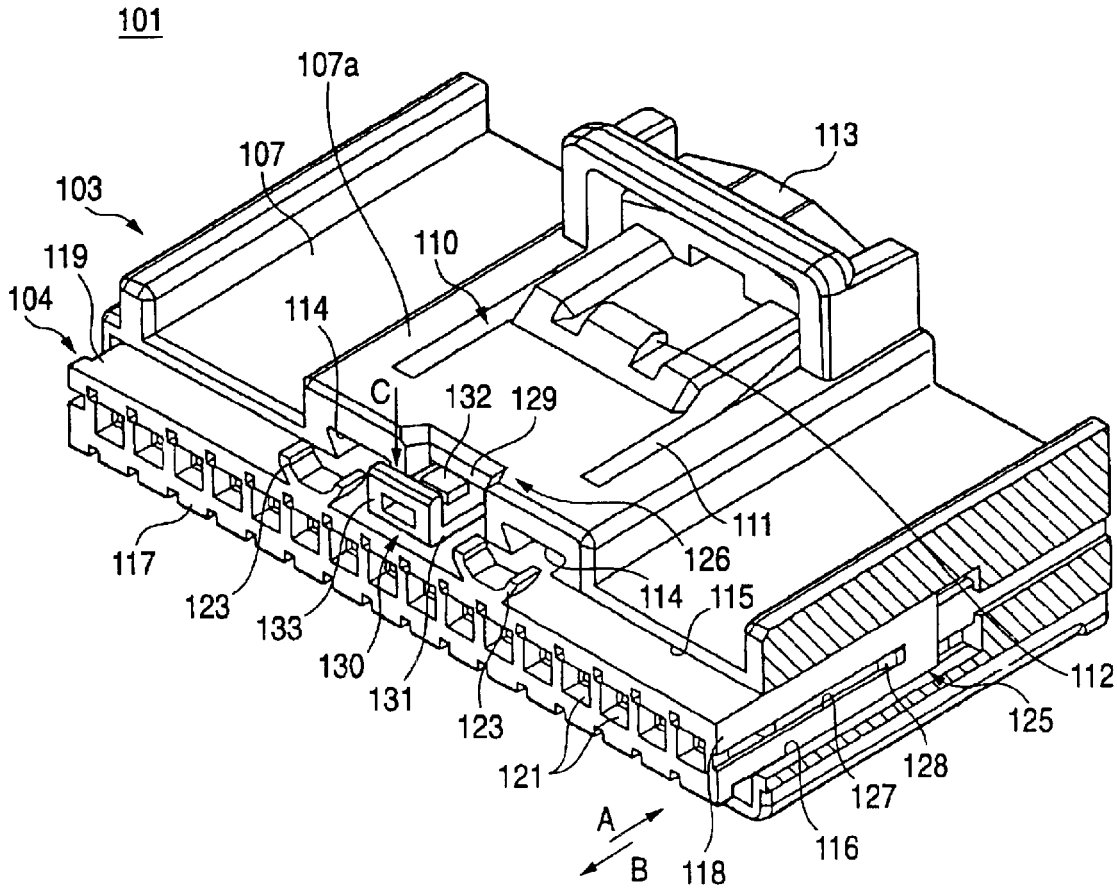
FIG. 10 is a partly-broken perspective view of the connector of the invention, showing side retaining member, with the front holder located in the provisionally-retaining position.
Figure 11:
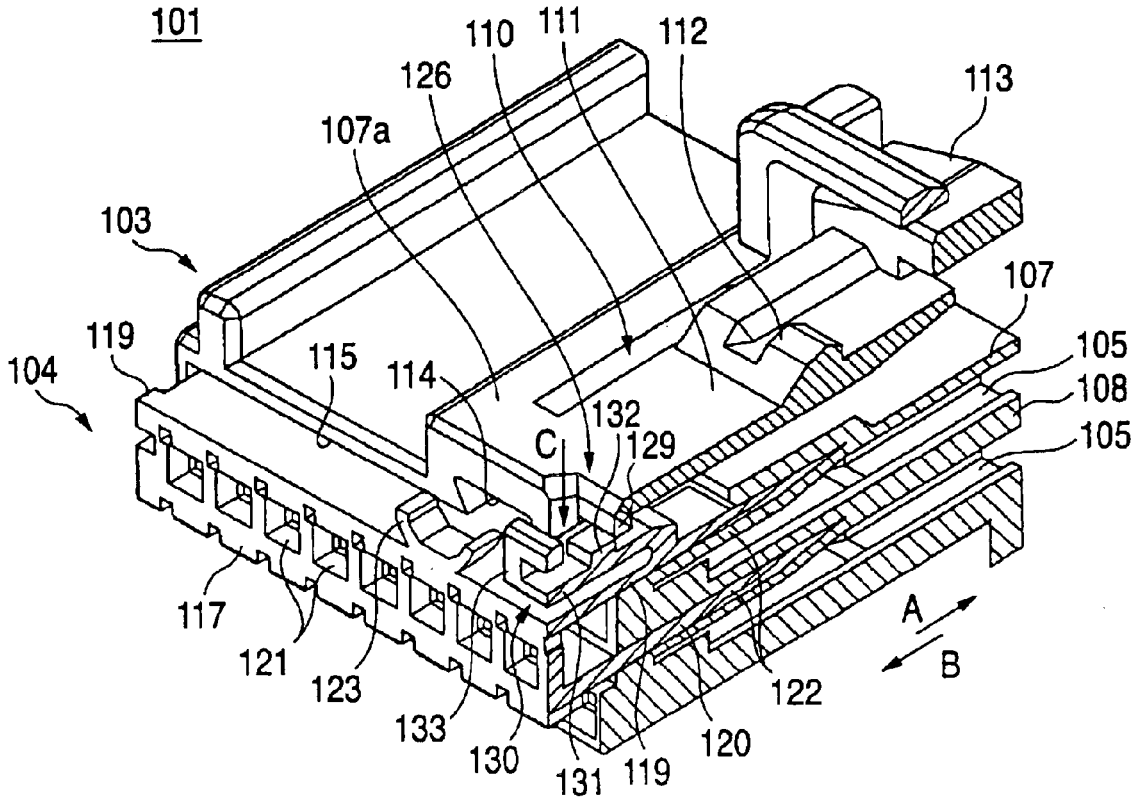
FIG. 11 is a partly-broken perspective view of the connector of the invention, showing center retaining member, with the front holder located in the provisionally-retaining position.
Figure 12:
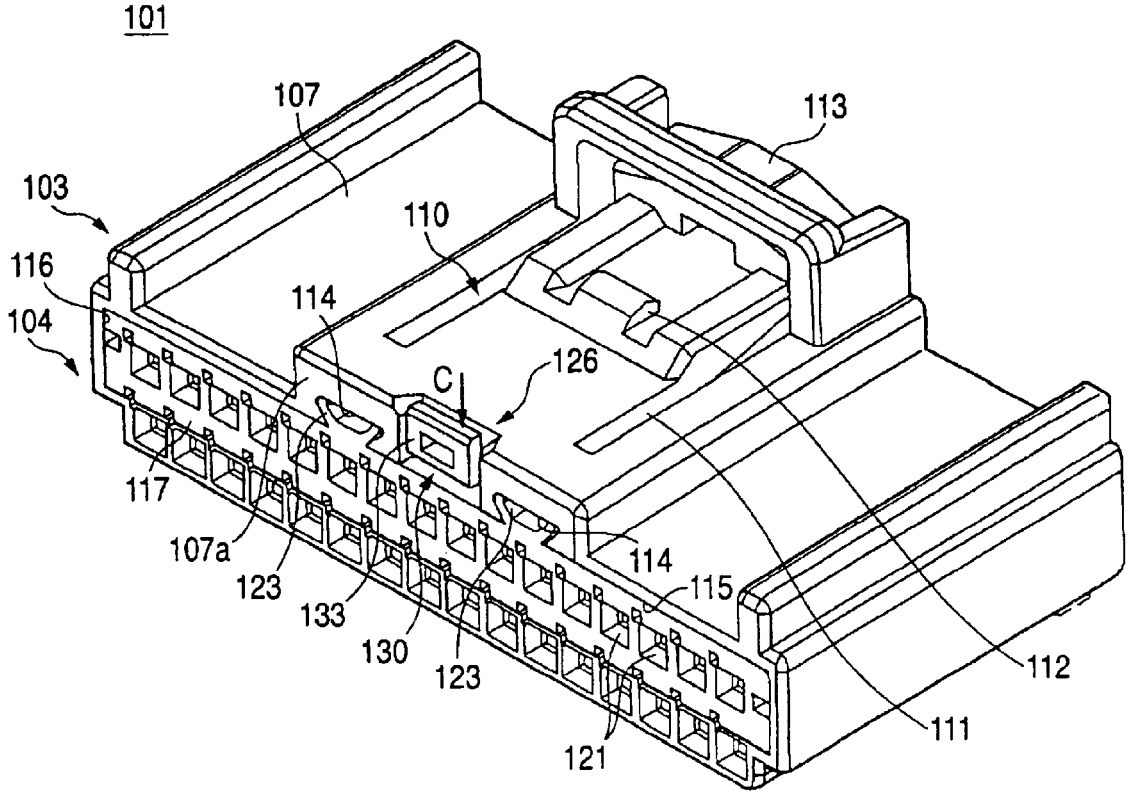
FIG. 12 is a perspective view of the connector of the invention, showing a condition in which the front holder is located in a completely-retaining position.
Figure 13:
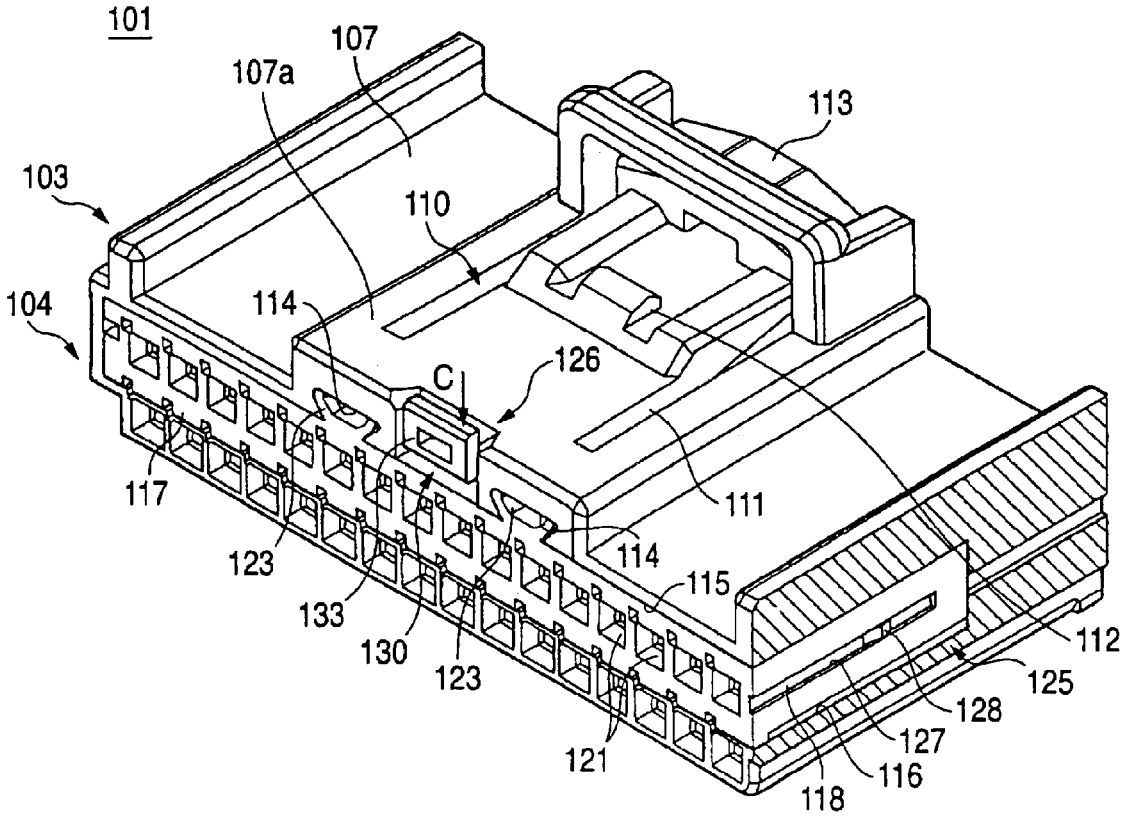
FIG. 13 is a partly-broken perspective view of the connector of the invention, showing the side retaining member, with the front holder located in the completely-retaining position.
Figure 14:
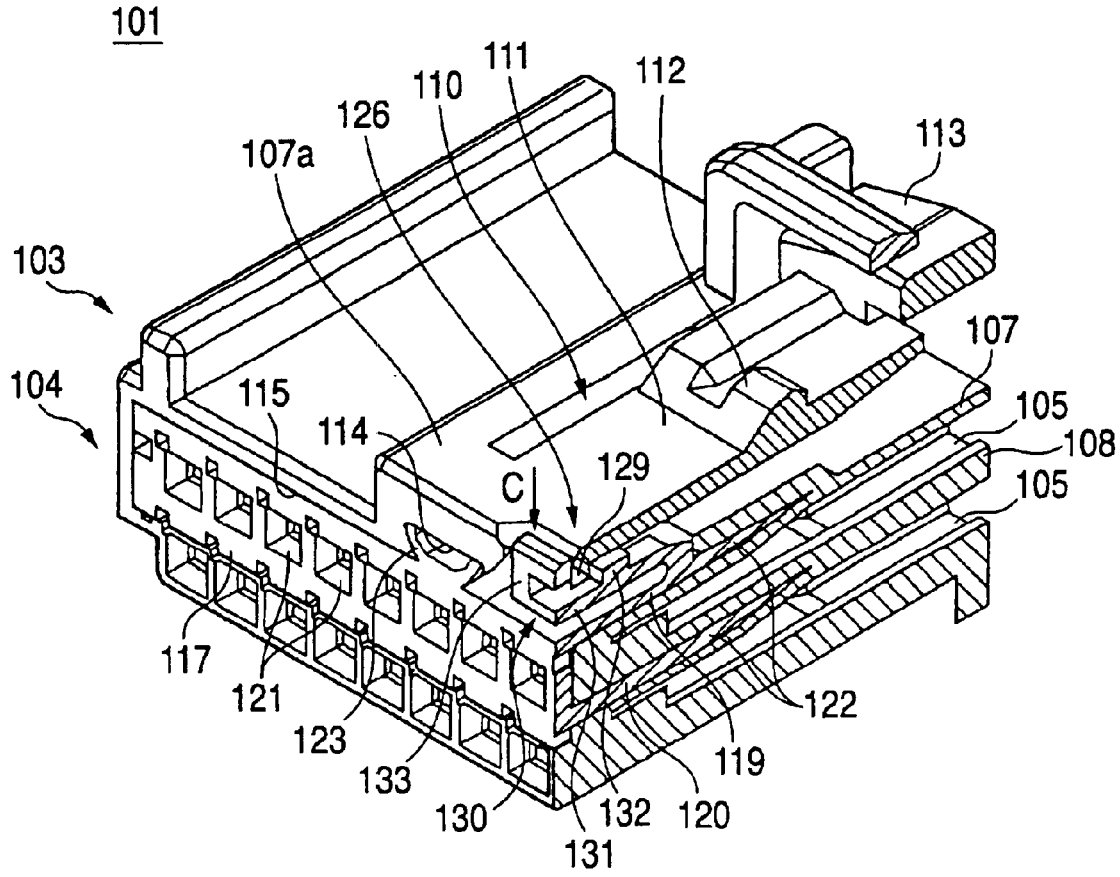
FIG. 14 is a partly-broken perspective view of the connector of the invention, showing the center retaining member, with the front holder located in the completely-retaining position.
Figure 15:
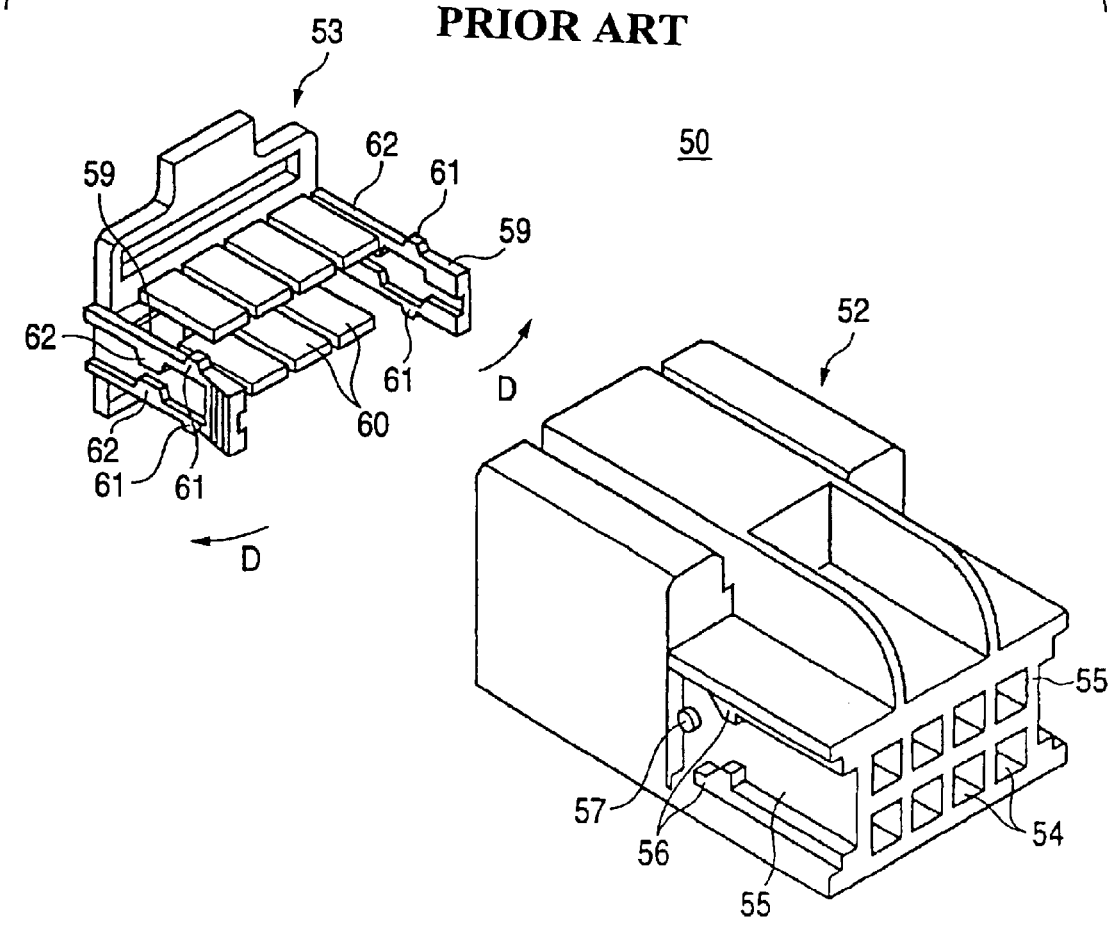
FIG. 15 PRIOR ART
FIG. 15 is a perspective view of a front holder of a related example.
Figure 16:
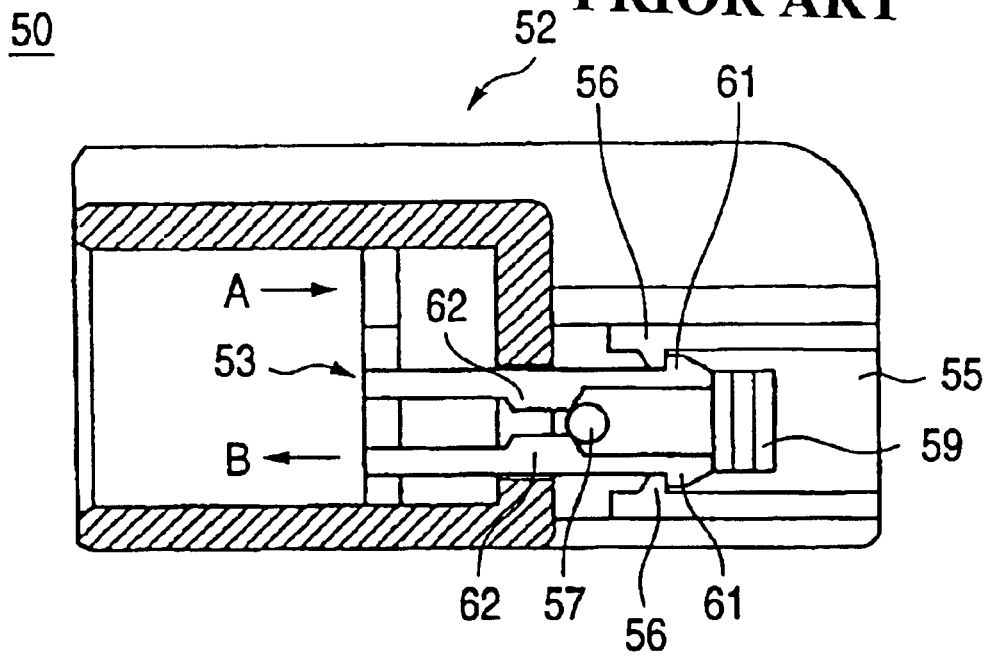
FIG. 16 PRIOR ART
FIG. 16 is a cross-sectional view of the related connector, showing a condition in which the front holder is located in a provisionally-retaining position.
Figure 17:
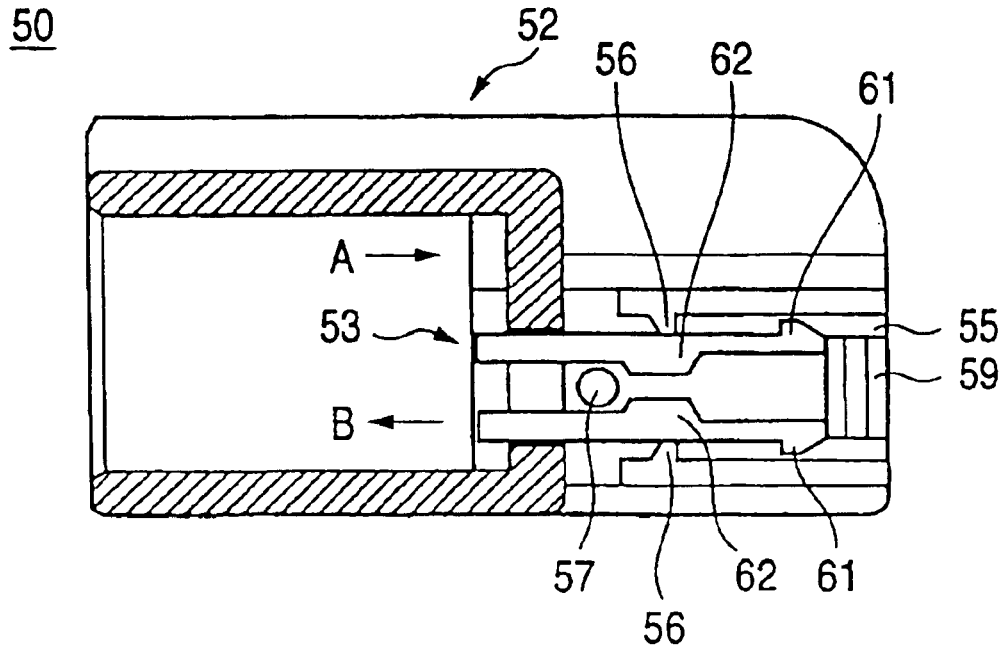
FIG. 17 PRIOR ART
FIG. 17 is a cross-sectional view of the related connector, showing a condition in which the front holder is located in a completely-retaining position.
Figure 18:
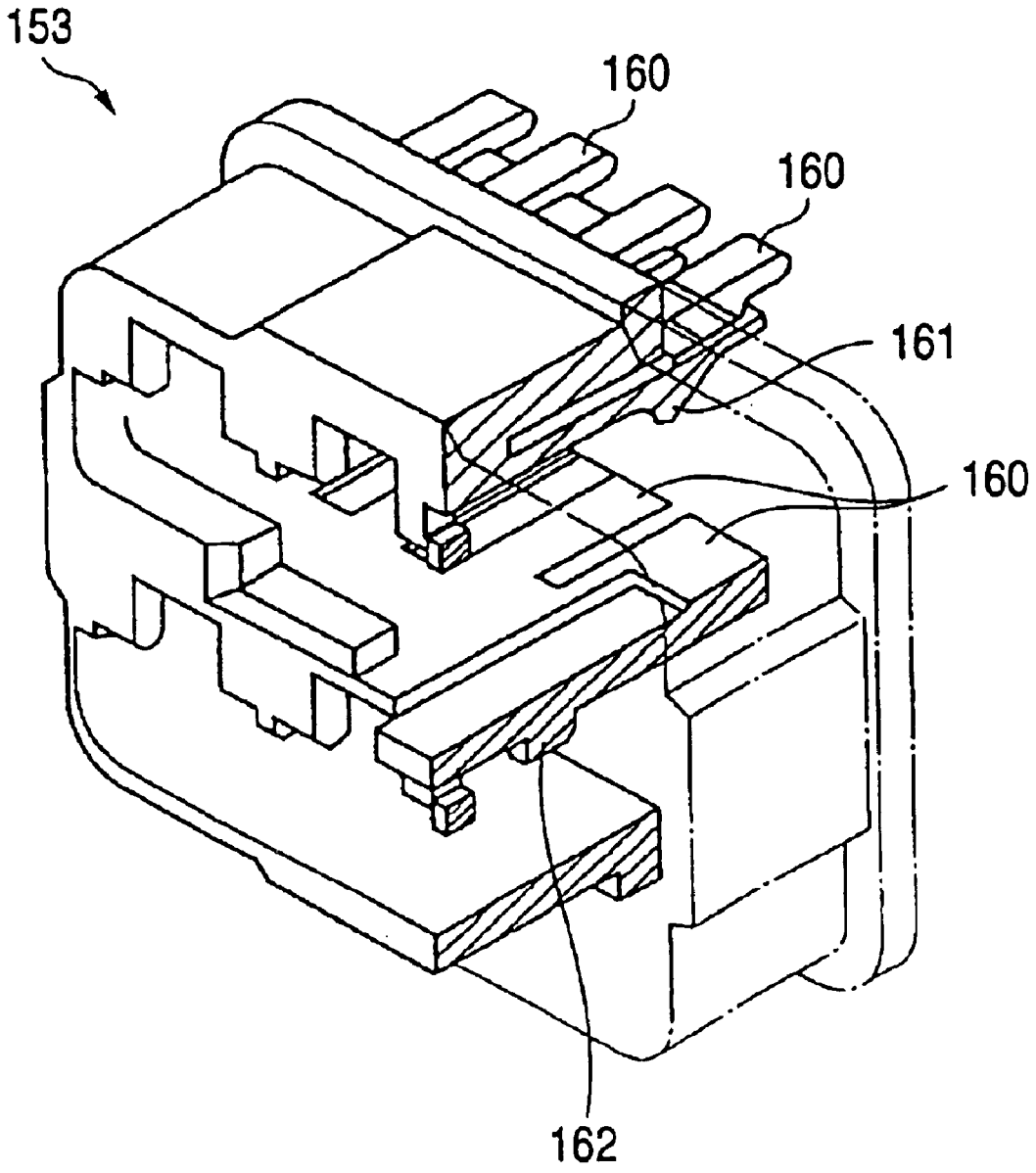
FIG. 18 PRIOR ART
FIG. 18 is a perspective view of a front holder of a related example.
Figure 19:
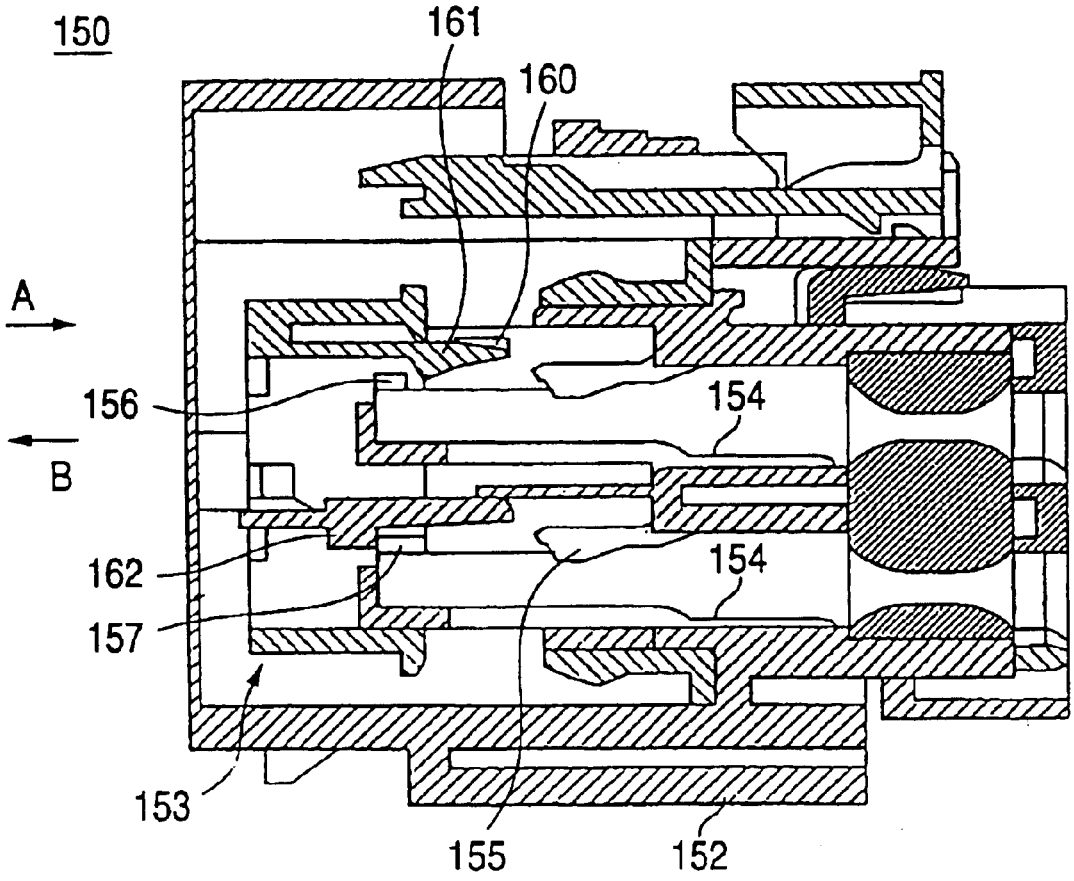
FIG. 19 PRIOR ART
FIG. 19 is a cross-sectional view of the related connector, showing a condition in which the front holder is located in a provisionally-retaining position.
Figure 20:
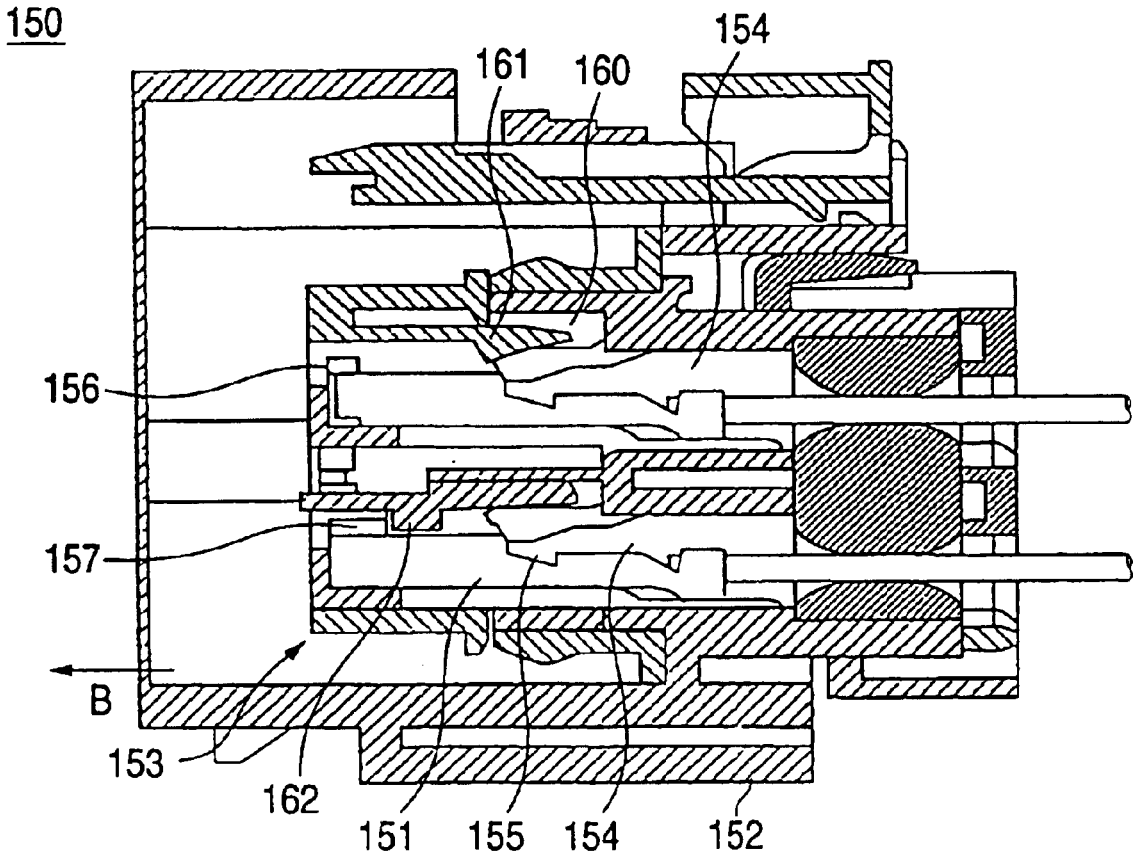
FIG. 20 PRIOR ART
FIG. 20 is a cross-sectional view of the related connector, showing a condition in which the front holder is located in a completely-retaining position.

FIGS. 8 to 14 show the second embodiment of the invention, and FIG. 8 is an exploded, perspective view showing a housing 103 and a front holder 104, FIG. 9 is a perspective view of a connector 101, showing a condition in which the front holder 104 is located in a provisionally-retaining position, FIG. 10 is a partly-broken perspective view of the connector 101, showing side retaining member 125, with the front holder 104 located in the provisionally-retaining position, and FIG. 11 is a partly-broken perspective view of the connector 101, showing center retaining member 126, with the front holder 104 located in the provisionally-retaining position, FIG. 12 is a perspective view of the connector 101, showing a condition in which the front holder 104 is located in a completely-retaining position, FIG. 13 is a partly-broken perspective view of the connector 101, showing the side retaining member 125, with the front holder 104 located in the completely-retaining position, and FIG. 14 is a partly-broken perspective view of the connector 101, showing the center retaining member 126, with the front holder 104 located in the completely-retaining position.

As shown in FIGS. 8 to 11, the connector 101 includes a plurality of female metal terminals (not shown) connected respectively to end portions of wires, the housing 103 for receiving the plurality of metal terminals therein, and the front holder 104 attached to the housing 103.

The housing 103 has a generally flattened rectangular shape, and a number of terminal receiving chambers 105 are formed in this housing, and the metal terminals are received in the terminal receiving chambers 105, respectively. The plurality of terminal receiving chambers 105 are arranged in two (upper and lower) rows (stages), and are juxtaposed in a transverse direction, and each terminal receiving chamber 105 has front and rear ends open to the exterior. Elastic retaining arm portions (not shown) extend from an inner face of an outer peripheral wall 107 respectively into the upper row of terminal receiving chambers 105, and elastic retaining arm portions (not shown) extend from a lower face of a partition wall 108 respectively into the lower row of terminal receiving chambers 105. The metal terminals are retained by theses elastic retaining arm portions, respectively.

A lock portion 110 for locking a mating connector (not shown) in a fitted condition is formed on an upper face of the outer peripheral wall 107 of the housing 103. The lock portion 110 includes an arm portion 111 which is fixedly secured at one end thereof to a support portion 107*a* of the outer peripheral wall 107, and has the other end portion (free end portion) extending toward a rear side of the housing 103, a retaining projection 112 formed on an upper face of the free end portion of the arm portion 111, and an operating portion 113 formed on that portion of this free end portion disposed rearwardly of the retaining projection 112. Dovetail grooves 114 are formed respectively in right-left symmetrically-disposed portions of the support portion 107*a* of the outer peripheral wall 107, and these dovetail grooves 114 are open to the inner face of the outer peripheral wall 107.

A front plate-receiving recess 115 is formed in the fitting side (face) of the housing 103 (into which the mating connector (not shown) is fitted) such that the upper-stage terminal insertion port side of this housing is recessed by a predetermined amount. A pair of right and left side plate-inserting holes 116 are formed in the housing 103, and are disposed respectively exteriorly of right and left sides of a terminal receiving area where the plurality of terminal receiving chambers 105 are provided. The front holder 104 can be inserted into the housing, using the front plate-receiving recess 115, the side plate-inserting holes 116 and so on.

The front holder 104 includes a front plate portion 117, right and left side plate portions 118 extending rearwardly respectively from opposite ends of the front plate portion 117, and a pair of upper and lower plate portions 119 and 120 extending rearwardly respectively from upper and lower edges of the front plate portion 117. The front holder 104 is inserted into the housing 103 such that rear end portions of the side plate portions 118 serve as inserting distal ends. Upper-stage terminal Insertion ports 121 are formed in the front plate portion 117. Rear end portions of the upper and lower plate portions 119 and 120 serve as arm deformation prevention portions 122, respectively, and each arm deformation prevention portion 122 is inserted in flexure spaces each formed between the elastic retaining arm portion (not shown) and the upper face of the terminal receiving chamber 105. Dovetail groove-engaging projections 123 are formed respectively at right-left symmetrically-disposed portions of the upper plate portion 119, and the pair of dovetail groove-engaging projections 123 are inserted in the pair of dovetail grooves 114, respectively.

Provisionally-retaining member (for holding the front holder 104 in the provisionally-retaining position during the insertion of the front holder 104 into the housing 103) and completely-retaining member for holding the front holder 104 in the completely-retaining position are provided between the housing 103 and the front holder 104.

In the second embodiment, the provisionally-retaining member includes the pair of right and left side retaining member 125 and the center retaining member 126. The pair of right and left side retaining member 125 are provided respectively exteriorly of the right and left sides of the terminal receiving area (when viewed from a direction A of insertion of the front holder 104 into the housing 103) where the plurality of terminal receiving chambers 105 are provided. The center retaining member 126 is provided above the terminal receiving area. In this embodiment, the completely-retaining member includes the center retaining member 126. Namely, the center retaining member 126 serves as part of the provisionally-retaining member and also as the completely-retaining member.

Each of the side retaining member 125 includes a guide hole 127 and a retaining projection. The guide hole 127 is formed in the side plate portion 118 of the front holder 104, and extends in the direction A of insertion of the front holder 104. The retaining projection 128 (shown in FIGS. 10 and 13) is provided in a projected manner in the side plate-inserting hole 16 of the housing 103, and is slidably inserted in the guide hole 127. In the provisionally-retaining position, the retaining projection 128 abuts against an end face of the guide hole 127.

The center retaining member 126 includes a retaining projection 129 and a resilient arm lock portion 130. The retaining projection 129 is formed on and projects from the inner face of the support portion 107*a* of the housing 103 at a widthwise-central portion thereof. The resilient arm lock portion 130 is formed on and projects upwardly from the upper plate portion 119 of the front holder 104 at a central portion thereof. A front (outer) face and a rear (inner face) of the retaining projection 129 are defined by vertical faces, respectively. The resilient arm lock portion 130 includes an arm portion 131, a retaining projection 132 and an operating portion 133. The arm portion 131 is fixedly secured at one end thereof to the upper plate portion 119, and has the other end portion (free end portion) extending toward the front plate portion 117. The retaining projection 132 is formed on an upper face of the arm portion 131 at a central portion thereof. The operating portion 133 is formed at the free end of the arm portion 131. Like the retaining projection 129, the retaining projection 132 has front and rear vertical faces. When the operating portion 133 is pressed down in a direction C, the arm portion 131 is elastically deformed, so that the retaining projection 132 is moved into a position where this retaining projection 132 will not interfere with the retaining projection 129. The positional relation is so determined that in the provisionally-retaining position, the retaining projection 132 of the resilient arm lock portion 130 can abut against the outer face of the retaining projection 129 and that in the completely-retaining position, the retaining projection 132 of the resilient arm lock portion 130 can abut against the inner face of the retaining projection 129.

Next, the assembling operation of the connector 101 will be described. The front holder 104 is inserted into the housing 103 from the fitting side (front side) thereof. In this inserting operation, the right and left side plate portions 118 of the front holder 104 are forcibly elastically deformed away from each other, so that the pair of retaining projections 128 of the housing 103 are engaged respectively in the pair of guide holes 127, and therefore the front holder is located in the provisionally-retaining position as shown in FIGS. 9 to 11. As a result of insertion of the front holder 104, the retaining projection 132 of the resilient arm lock portion 130 abuts against the retaining projection 129 of the housing 103. In this provisionally-retaining position, the movement of the front holder 104 in the inserting direction A is prevented by the retaining engagement between the retaining projections 129 and 132 of the center retaining member 126, and also the movement of the front holder 104 in the withdrawing direction B is prevented by the retaining engagement between the retaining projection 128 of each of the two side retaining member 125 and the end face of the corresponding guide hole 127 Therefore, the front holder 104 is provisionally attached to the housing 103, and also the arm deformation prevention portions 122 of the front holder 104 are held respectively in predetermined positions so as not to prevent the insertion of the metal terminals (not shown).

In this provisionally-retained condition, the metal terminals (not shown) are inserted respectively into the terminal receiving chambers 105 of the housing 103 through the rear open ends thereof. As a result, the distal end of each metal terminal is brought into abutting engagement with the corresponding elastic retaining arm portion (not shown). In this condition, when the metal terminal is further inserted, the free end portion of the elastic retaining arm portion is elastically deformed into the flexure space, thereby allowing the insertion of the metal terminal. When the metal terminal is inserted into the proper inserting position, the free end portion of the elastic retaining arm portion is brought into registry with a retaining portion (not shown) of the metal terminal, and therefore is elastically restored to retain the metal terminal.

Then, the operating portion 133 of the resilient arm, lock portion 130, formed on the front holder 104 held in the provisionally-retained condition at the fitting side (front side) of the housing 103, is pressed down in the direction C, and then the front holder 104 is further inserted into the housing 103. At this time, the front holder is inserted into the position where the retaining projection 132 of the resilient arm lock portion 130 of the front holder 104 is retainingly engaged with the inner face of the retaining projection 129 of the housing 103, and then the pressing of the operating portion 133 is released, so that the front holder is held in the completely-retaining position as shown in FIGS. 12 to 14. As a result of insertion of the front holder 104, each arm deformation prevention portion 122 is inserted in the flexure spaces each formed between the elastic retaining arm portion and the upper face of the terminal receiving chamber 105. In the completely-retaining position, the movement of the front holder 104 in the withdrawing direction B is prevented by the retaining engagement between the retaining projections 129 and 132 of the center retaining member 126, and therefore the front holder 104 is completely attached to the housing 103, and also the arm deformation prevention portions 122 are held respectively in predetermined positions to prevent the withdrawal of the metal terminals (not shown).

When the front holder 104 is moved from the completely-retaining position to the provisionally-retaining position because of some trouble (for example, because part of the plurality of metal terminals have failed to be properly inserted), the operating portion 133 of the resilient arm lock portion 130 is pressed down in the direction C, and then the front holder 104 is drawn from the housing 103. At this time, the front holder is drawn into the position where each of the two retaining projections 128 of the housing 103 is retainingly engaged with the end face of the corresponding guide hole 127 in the front holder 104 as shown in FIGS. 9 to 11, and then the pressing of the operating portion 133 of the resilient arm lock portion 130 is released, thus holding the front holder in the provisionally-retaining position.

As described above, in the connector 101, the pair of side retaining member 125 and the center retaining member 126 are disposed outside the terminal receiving space, and therefore the structure of the two side retaining member 125 and the structure of the center retaining member 126 can be determined without imposing any limitation on the size of the metal terminals to be used. Therefore, even in a small-size connector using small metal terminals (not shown), the front holder 104 can be attached to the housing 103, and besides the front holder can be retained in the provisionally-retaining position and the completely-retaining position with the desired position-holding force.

In the second embodiment, the provisionally-retaining member includes the pair of right and left side retaining member 125 which are provided respectively exteriorly of the right and left sides of the terminal receiving area, and the center retaining member 126 provided exteriorly of one of the upper and lower sides of the terminal receiving area. The completely-retaining member includes the center retaining member 126. Thus, the center retaining member 126 serves as part of the provisionally-retaining member and also as the completely-retaining member, and therefore the pair of side retaining member 125 can be simplified in construction.

In the second embodiment, each of the side retaining member 125 includes the guide hole 127 which is formed in the front holder 104, and extends in the direction of insertion of the front holder 104, and the retaining projection 128 which is provided at the housing 103, and is slidably inserted in the guide hole 127. In the provisionally-retaining position, the retaining projection 128 abuts against the end face of the guide hole 127, thereby holding the front holder in position, and therefore the movement of the front holder 104 between the provisionally-retaining position and the completely-retaining position is effected positively and smoothly.

In the second embodiment, although the guide holes 127 are formed in the front holder 104, while the retaining projections 128 are formed on the housing 103, there may be adopted a reverse construction in which the guide holes 127 are formed in the housing 103 while the retaining projections 128 are formed on the front holder 104.

In the second embodiment, although the present invention is applied to the connector 101 for the female terminals, the invention can, of course, be applied to a connector for male terminals.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector, comprising:

a housing, including:

a plurality of terminal receiving chambers in which metal terminals are accommodated; and a plurality of elastic retaining arm portions for respectively retaining the metal terminals;

a front holder, attached to the housing in a completely-retaining position through a provisionally-retaining position;

wherein the front holder prevents the elastic deformation of the elastic retaining arm portions in the completely-retaining position; and wherein the front holder allows the elastic deformation of the elastic retaining arm portions in the provisionally-retaining position;

a provisionally-retaining mechanism, retaining the front holder to the housing in the provisionally-retaining position; and a completely-retaining mechanism, retaining the front holder to the housing in the completely-retaining position, wherein the completely-retaining mechanism is provided at one region so as to retain the housing and the front holder, and includes an operation portion for releasing the retaining of the housing and the holder, and the operating portion is disposed so as to be exposed to the exterior.

2. The connector as set forth in claim 1, wherein the completely-retaining mechanism includes a center retaining mechanism which is provided generally at a central portion of the housing and front holder.

3. The connector as set forth in claim 2, wherein the center retaining mechanism includes a first retaining portion provided on the housing, and a resilient arm lock portion provided on the front holder;

wherein the resilient arm lock portion, includes;

an elastically-deformable arm which is fixed to the front holder at one end of the arm;

a second retaining portion which is formed on and projecting from a free end portion of the arm; and the operating portion which is provided on the free end of the arm, and makes the arm elastically deformed so as to displace the second retaining portion into a lock released position; and wherein the second retaining portion of the resilient arm lock portion is engaged with the first retaining portion in the completely-retaining position.

4. The connector as set forth in claim 3, wherein the second retaining portion of the resilient arm lock portion is engaged with the first retaining portion in the provisionally-retaining position to prevent the front holder from moving from the provisionally-retaining position to the completely-retaining position.

5. The connector as set forth in claim 3, wherein the first retaining portion is provided on the housing; and wherein the resilient arm lock portion is provided on the front holder.

6. The connector as set forth in claim 5, wherein an insertion hole is formed in the housing;

wherein the insertion hole is used for removing a mold when injection molding the first retaining portion of the housing; and wherein the resilient arm lock portion is inserted in the insertion hole when the front holder is disposed in the completely-retaining position.

7. The connector as set forth in claim 3, wherein the second retaining portion of the arm includes;

a first face which is disposed close to the free end of the arm, and is slanted relative to a direction of extending of the arm; and a second face which is disposed close to the fixed end of the arm, and is perpendicular to the direction of extending of the aim; and wherein the first retaining portion includes;

a third face which is slanted, and abuts against the first face of the second retaining portion in the provisionally-retaining position; and a fourth face which is generally parallel to the second face of the retaining portion, and abuts against the second face in the completely-retaining position.

8. The connector as set forth in claim 3, wherein the first retaining portion includes a pair of opposed first projections formed respectively on a pair of ribs extending parallel to the direction of extending of the resilient arm lock portion; and wherein the second retaining portion includes a pair of second projections formed on the arm.

9. The connector as set forth in claim 1, wherein the front holder and the housing are released from the completely-retaining position by displacing the operating portion outwardly.

10. A connector, comprising:

a housing, including:

a plurality of terminal receiving chambers in which metal terminals are accommodated; and a plurality of elastic retaining arm portions for respectively retaining the metal terminals;

a front holder, inserted into the housing from a fitting side of the housing, and attached to the housing in a completely-retaining position through a provisionally-retaining position;

wherein the front holder prevents the elastic deformation of the elastic retaining arm portions in the completely-retaining position; and wherein the front holder allows the elastic deformation of the elastic retaining arm portions in the provisionally-retaining position;

a provisionally-retaining mechanism, retaining the front holder in the housing in the provisionally-retaining position; and a completely-retaining mechanism, retaining the front holder in the housing in the completely-retaining position;

wherein the provisionally-retaining mechanism and the completely-retaining mechanism are provided on an exterior of a terminal receiving area where the plurality of terminal receiving chambers are provided as viewed from a first direction in which the front holder is inserted into the housing;

wherein the provisionally-retaining mechanism includes;

a pair of side retaining members which are respectively provided at opposite sides of the terminal receiving area in a second direction perpendicular to the first direction; and a center retaining mechanism which is provided at a side of the terminal receiving area in a third direction perpendicular to both the first direction and the second direction; and wherein the completely-retaining mechanism is formed by the center retaining mechanism disposed generally at a central position of the terminal receiving area in the second direction.

11. The connector as set forth in claim 10, wherein each of the side retaining members includes;

a guide hole which is formed in one of the housing and the front holder, and extends in the first direction; and a retaining projection which is provided at the other of the housing and the front holder, and is slidably inserted in the guide hole; and wherein the retaining projection abuts against an end face of the guide hole to retain the front holder in the provisionally-retaining position.

12. The connector as set forth in claim 11, wherein the guide hole is formed in the front holder; and wherein the retaining projection is formed on the housing.

* * * * *